US010317115B2

(12) United States Patent
Han et al.

(10) Patent No.: US 10,317,115 B2
(45) Date of Patent: Jun. 11, 2019

(54) REFRIGERATOR

(71) Applicant: LG ELECTRONICS INC., Seoul (KR)

(72) Inventors: Junsoo Han, Seoul (KR); Dongseok Kim, Seoul (KR); Kangsoo Byun, Seoul (KR); Younseok Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/674,912

(22) Filed: Aug. 11, 2017

(65) Prior Publication Data

US 2018/0087814 A1 Mar. 29, 2018

(30) Foreign Application Priority Data

Sep. 29, 2016 (KR) ..... 10-2016-0125946

(51) Int. Cl.
*F25B 39/02* (2006.01)
*F25D 17/06* (2006.01)
*F25D 23/06* (2006.01)

(52) U.S. Cl.
CPC ..... *F25B 39/02* (2013.01); *F25D 17/065* (2013.01); *F25D 17/067* (2013.01); *F25D 23/069* (2013.01); *F25D 2317/063* (2013.01); *F25D 2317/0666* (2013.01); *F25D 2321/142* (2013.01); *F25D 2321/1441* (2013.01); *F25D 2500/02* (2013.01)

(58) Field of Classification Search
CPC ..... F25B 39/02; F25D 17/067; F25D 23/069; F25D 17/065; F25D 2500/02; F25D 2321/1441; F25D 2321/142; F25D 2317/063; F25D 2317/0666
See application file for complete search history.

(56) References Cited

U.S. PATENT DOCUMENTS

| | | | |
|---|---|---|---|
| 3,310,957 | A | 3/1967 | Saunders et al. |
| 4,086,785 | A | 5/1978 | Kochendorfer et al. |
| 2011/0011106 | A1 | 1/2011 | Ahn et al. |
| 2012/0096887 | A1 | 4/2012 | Cho et al. |

FOREIGN PATENT DOCUMENTS

| | | |
|---|---|---|
| DE | 10 2006 015 992 | 10/2007 |
| EP | 0 403 838 | 12/1990 |
| EP | 2 694 894 | 3/2016 |
| WO | WO 2011/007959 | 1/2011 |
| WO | WO 2012/136532 | 10/2012 |
| WO | WO 2013/098110 | 7/2013 |

OTHER PUBLICATIONS

European Search Report dated Feb. 5, 2018 issued in Application No. 17193178.5.

*Primary Examiner* — Ana M Vazquez
(74) *Attorney, Agent, or Firm* — Ked & Associates, LLP

(57) ABSTRACT

A refrigerator includes evaporator cases arranged in a freezing chamber and located on a bottom surface of a partition wall, an evaporator installed inside the evaporator cases, and grill covers arranged on a rear side of the evaporator cases and having a blowing fan installed therein. The refrigerator includes a refrigerating chamber discharge passage which extends from the grill covers to a refrigerating chamber and through which at least a portion of cold air passing through the blowing fan flows, and a freezing chamber discharge passage which extends from the grill covers to the freezing chamber and through which the remaining cold air among the cold air passing through the blowing fan passes.

21 Claims, 22 Drawing Sheets

REFRIGERATOR

CROSS-REFERENCE TO RELATED APPLICATION

This application claims priority under 35 U.S.C. 119 and 35 U.S.C. 365 to Korean Patent Application No. 10-2016-0125946 filed on Sep. 29, 2016 in Korea, the entire contents of which is hereby incorporated by reference in its entirety.

BACKGROUND

1. Field

The present disclosure relates to a refrigerator.

2. Background

In general, a refrigerator includes a plurality of storage chambers in which stored goods are accommodated in a frozen state or a refrigerated state, and surfaces of the storage chambers are opened such that the food can be withdrawn. The plurality of storage chambers include a freezing chamber configured to store food in a frozen state and a refrigerating chamber configured to store food in a refrigerated state.

A refrigeration system in which refrigerant circulates is operated in the refrigerator. Devices constituting the refrigeration system include a compressor, a condenser, an expansion device and an evaporator. The refrigerant may be evaporated while passing through the evaporator, and in this process, air passing through the vicinity of the evaporator may be cooled. Further, the cooled air may be supplied to the freezing chamber or the refrigerating chamber. In general, the evaporator is installed on a rear side of the storage chambers and extends vertically.

In recent years, enlarging an inner storage space, specifically, the storage chambers, of the refrigerator is a main concern of consumers. Thus, there have been a large number of efforts to reduce a space accommodating components of the refrigeration system required in the refrigerator and to relatively increase the volumes of the storage chambers. However, as described above, when the evaporator is provided on the rear side of the storage chambers, there is a difficulty in that the sizes of the storage chambers used to be reduced to secure a space for installation of the evaporator.

In particular, the refrigerator includes drawers that may be withdrawn forwards from the storage chambers. There is a problem in that as the sizes, in particular, the front to-back lengths, of the storage chambers are reduced due to arrangement of the evaporator, and accordingly, the withdrawal distances of the drawers are reduced. When the withdrawal distances of the drawers are reduced a drawer spaced is reduced, it is inconvenient for a user to accommodate food in the drawers.

To solve the above-described problems, installing the evaporator in a partition wall by which the refrigerating chamber and the freezing chamber are partitioned has been developed. In a side-by-side refrigerator in which a freezing chamber and a refrigerating chamber are arranged on left and right sides of the refrigerator, because a partition wall vertically extends between the freezing chamber and the refrigerating chamber, defrosting water generated by an evaporator may be easily discharged. However, in a refrigerator in which a refrigerating chamber and a freezing chamber are arranged on upper and lower sides of the refrigerator, because a partition wall transversely extends between the freezing chamber and the refrigerating chamber, it is difficult to discharge defrosting water generated by an evaporator.

Information on the related art will be described below.

1. European Patent No. EP 2,694,894 (published on Mar. 23, 2016)

2. Title of the invention: COMBINATION DEVICE FOR REFRIGERATION

A technology of installing an evaporator in a partition wall by which a refrigerating chamber and a freezing chamber are separated from each other in a refrigerator in which the refrigerating chamber is located at an upper portion of the refrigerator and the freezing chamber is located at a lower portion of the refrigerator is disclosed in the above related art. However, the evaporator according to the related art is inclined downwards toward a rear end. Such arrangement of the evaporator is to easily discharge defrosting water generated by the evaporator to a lower side. However, because the evaporator is inclined toward the rear end, the thickness of the partition wall for arranging an insulator and the evaporator may be increased. When the thickness of the partition wall is increased, storage chambers of the refrigerator become relatively smaller.

Further, a lower surface of the partition wall is inclined downward due to the inclined arrangement of the evaporator, and correspondingly, a side surface of a drawer provided at an upper portion of the freezing chamber is inclined downward toward the rear end. In this case, storage ability for food deteriorates.

According to the arrangement of the evaporator according to the related art, because a fan is located directly behind the evaporator, the defrosting water generated by the evaporator flows into the fan, and thus the fan may malfunction. Further, when cold air having high humidity passes through the fan, condensed water may be generated in the fan. According to the related art, a separate water passage to discharge the condensed water of the fan is not provided, and the condensed water flows to a duct to which the cold air is supplied. In this case, frost caused by the condensed water is in the duct.

A tray collecting the defrosting water must to be provided on a lower side of the evaporator. According to the arrangement of the evaporator according the related art, to decrease the thickness of the partition wall as much as possible, the tray should be provided on the lower side of the evaporator to be very close to the evaporator. In this case, because the defrosting water stored in the tray is frosted, heat exchange performance of the evaporator deteriorates.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Hereinafter, detailed embodiments of the present disclosure will be described with reference to the accompanying drawings. However, the spirit of the present disclosure is not limited to the proposed embodiments, and those skilled in the art who understand the spirit of the present disclosure may easily propose other embodiments within the same scope of the spirit.

Figure 1:
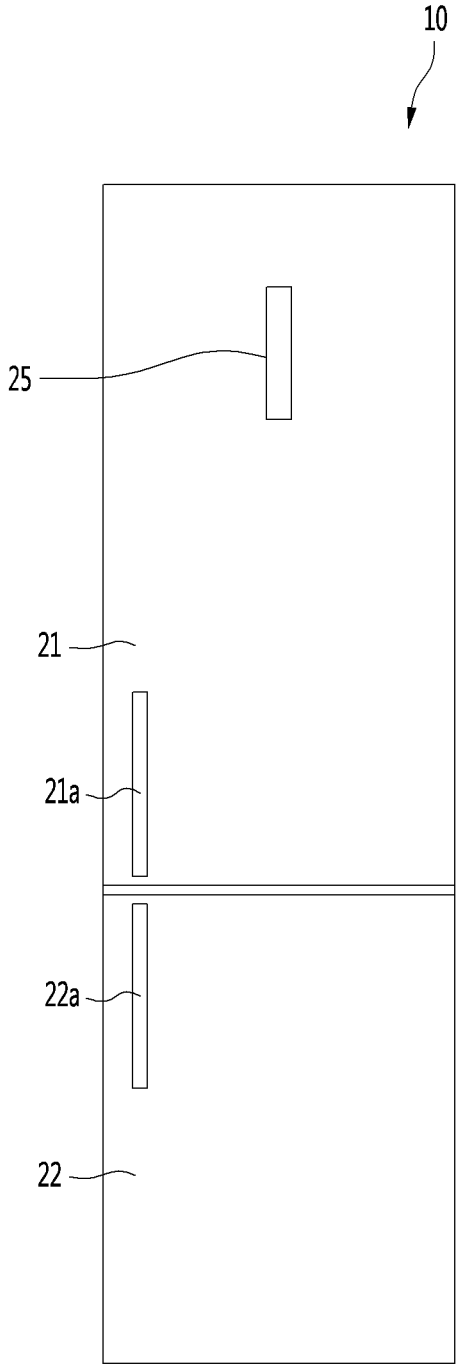
FIG. 1 is a front view illustrating a configuration of a refrigerator according to an embodiment of the present disclosure.
Figure 2:
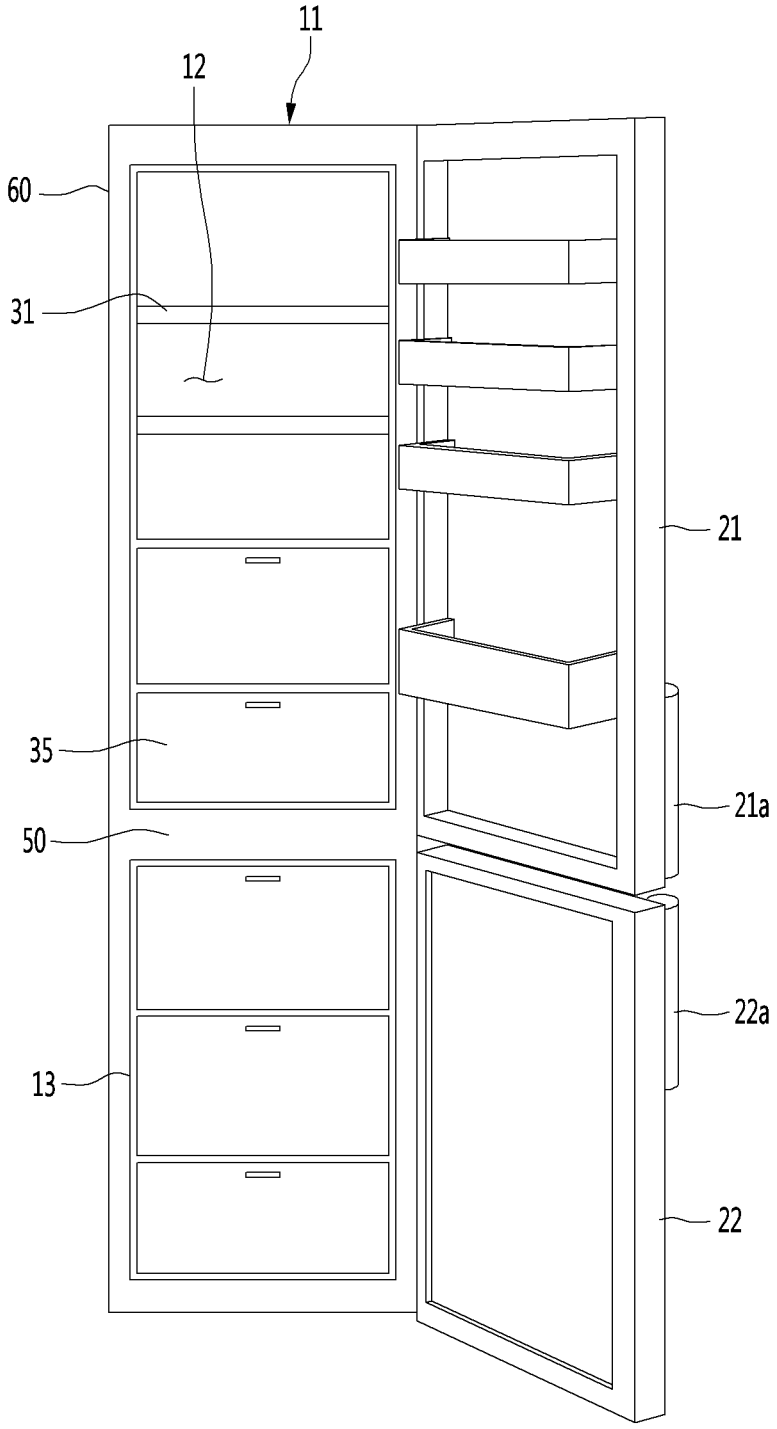
FIG. 2 is a front view illustrating the refrigerator, doors of which are opened, according to the embodiment.
Figure 3:
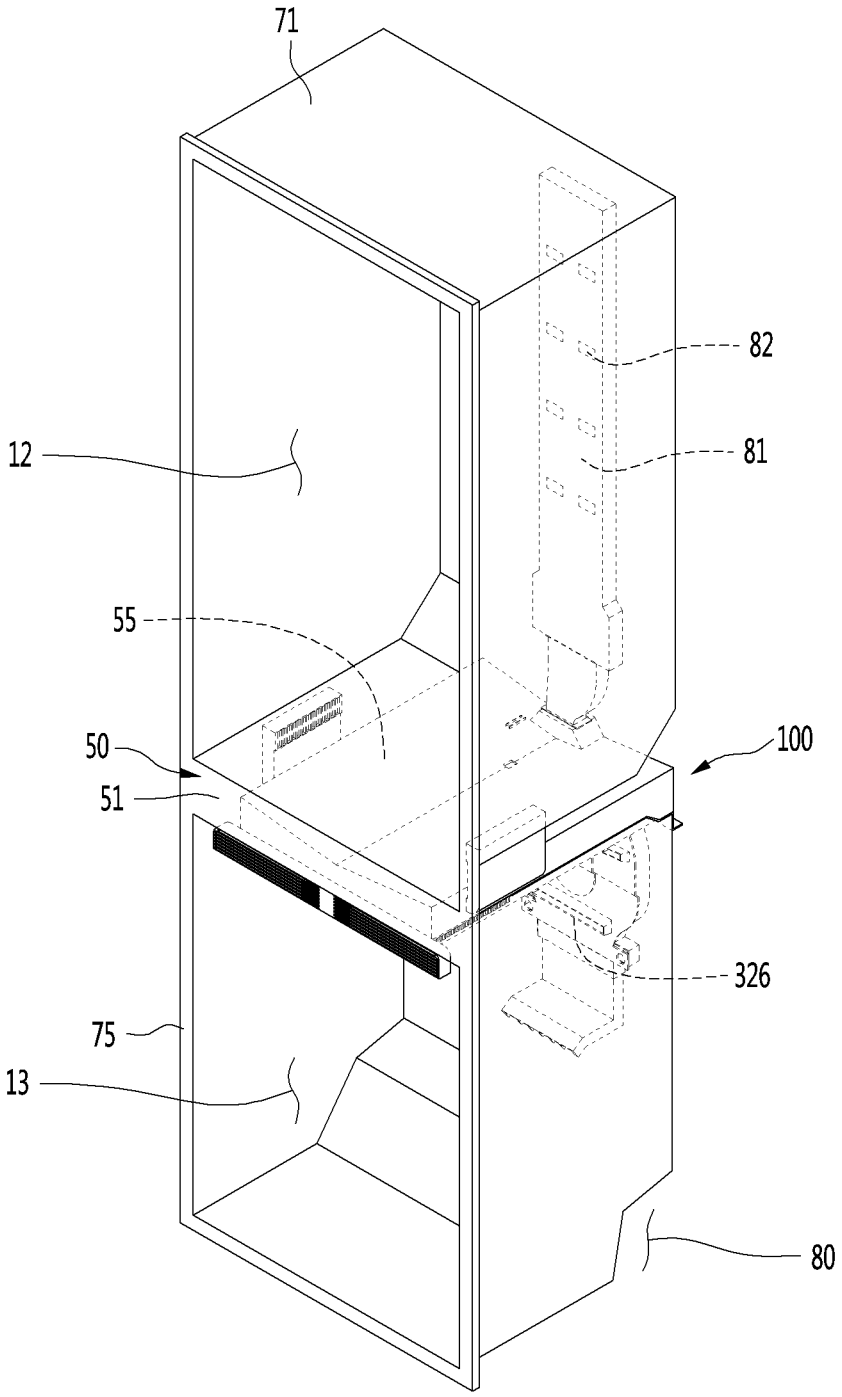
FIG. 3 illustrates an inner case and a cold air supplying device that are provided in the refrigerator according to the embodiment.
Figure 22:
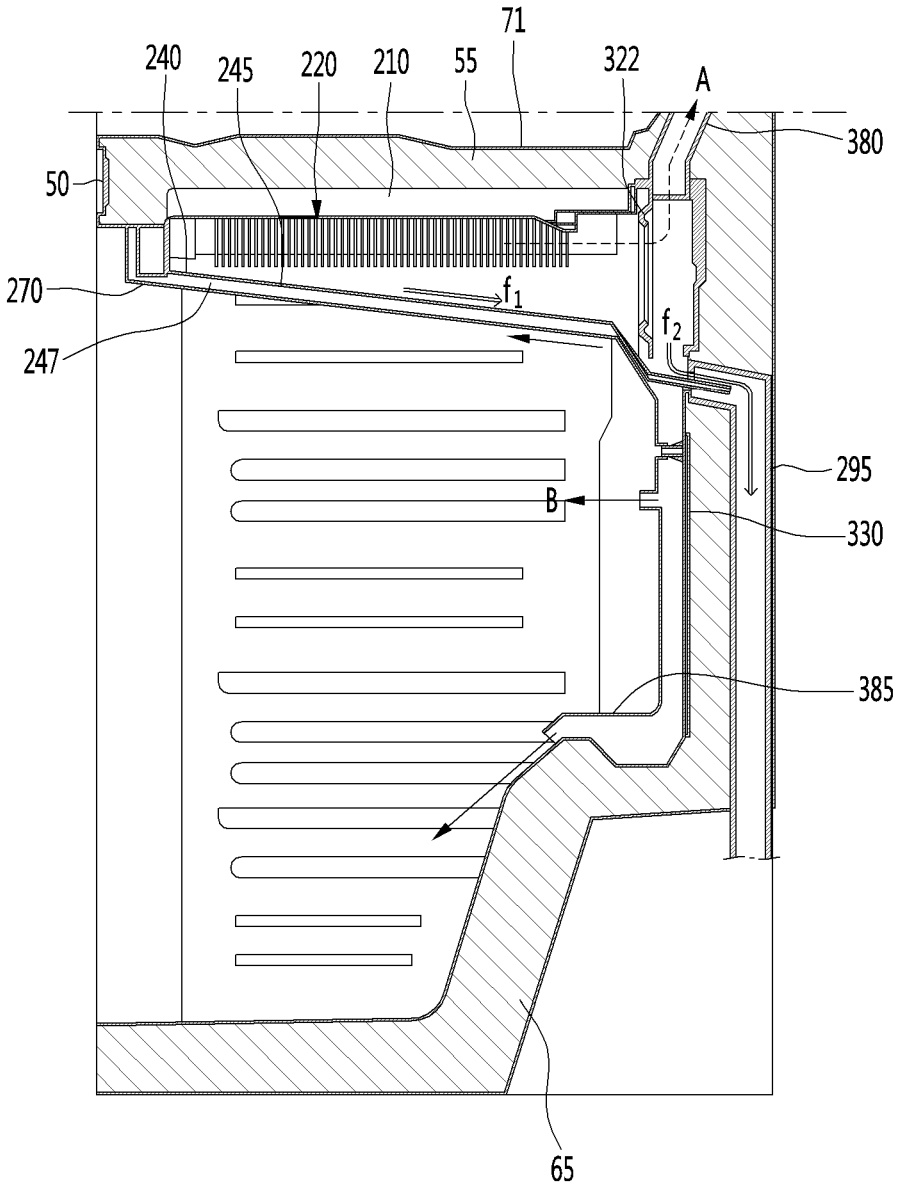
FIG. 22 illustrates a state in which defrosting water generated by the evaporator is discharged according to the embodiment.

Referring to FIGS. 1 to 3, a refrigerator 10 according to an embodiment may include a cabinet 11 in which storage chambers are provided and doors 21 and 22 provided on a front surface of the cabinet 11 to selectively open/close the storage chambers. The cabinet 11 may have a rectangular parallelepiped shape, a front surface of which is open. Further, the cabinet 11 may include an outer case 60 defining an outer appearance of the refrigerator and inner cases 70 coupled to an inside of the outer case 60 and defining inner surfaces of the storage chambers. A cabinet insulator 65 (see FIG. 22) configured to perform insulation between an outside of the refrigerator and the storage chambers may be provided between the outer case 60 and the inner cases 70.

The storage chamber may include first and second storage chambers 12 and 13 controlled to have different temperatures. The first storage chamber 12 may include refrigerating chamber 12, and the second storage chamber 13 may be a freezing chamber 13. As an example, the refrigerating chamber 12 may be formed at an upper portion of the cabinet 11 and the freezing chamber 13 may be formed at a lower portion of the cabinet 11.

The refrigerating chamber 12 may be arranged above the freezing chamber 13. According to such a configuration, because the refrigerating chamber 12 relatively frequently used to store or withdraw food may be arranged at a height corresponding to a waist of a user, the user needs not to bend his/her waist when the refrigerating chamber 12 is used, so that user convenience may be improved.

The refrigerator 10 may further include a partition wall 50 by which the refrigerating chamber 12 and the freezing chamber 13 are partitioned. The partition wall 50 may be provided in the cabinet 11 to extend from a front side toward a rear side of the cabinet 11.

As an example, the partition wall 50 may extend from the front side toward the rear side of the cabinet 11 in a direction that is parallel to the ground. Because temperatures formed at the refrigerating chamber 12 and the freezing chamber 13 are different from each other, a partition wall insulator 55 configured to insulate the refrigerating chamber 12 and the freezing chamber 13 from each other may be provided in the partition wall 50.

The doors 21 and 22 may include a refrigerating chamber door 21 rotatably provided on a front side of the refrigerating chamber 12 and a freezing chamber door 22 rotatably provided on a front side of the freezing chamber 13. As another example, the freezing chamber door 22 may be a drawer capable of being withdrawn forward. A first handle 21*a* that the user may grip may be provided on a front surface of the refrigerating chamber door 21, and a second handle 22*a* may be provided on a front surface of the freezing chamber door 22.

The refrigerator 10 may further include a plurality of shelves 31 provided in the storage chambers to accommodate food. As an example, the plurality of shelves 31 may be provided in the refrigerating chamber 12 to be vertically spaced apart from each other.

The refrigerator 10 may further include drawers 35 capable of being withdrawn from the storage chambers. The drawers 35 may be provided in the refrigerating chamber 12 and the freezing chamber 13, and may have accommodation spaces for food formed therein. The front-rear lengths of the drawers 35 may be increased as the front-rear widths of the storage chambers become larger, and accordingly, the withdrawal distances of the drawers 35 may be increased.

When the withdrawal distances of the drawers 35 are increased, convenience for the user to accommodate food may be improved. Thus, it is important in terms of user convenience that the refrigerator is configured such that the front-rear widths of the storage chambers may become relatively larger.

A direction in which the drawers 35 are withdrawn is defined as a forward direction, and a direction in which the drawers 35 are accommodated is defined as a rearward direction. Further, a leftward direction when the refrigerator 10 is viewed from a front side of the refrigerator 10 is defined as a leftward direction, and a rightward direction when the refrigerator 10 is viewed from the front side of the refrigerator 10 is defined as a rightward direction. The definition of the directions may be identically applied throughout the specification.

The refrigerator 10 may further include a display unit or display 25 configured to display information on the temperatures and operating states of the storage chambers of the refrigerator. As an example, the display 25 may be provided on the front surface of the refrigerating chamber door 21.

The inner cases 70 may include an inner refrigerating chamber case 71 defining the refrigerating chamber 12. The inner refrigerating camber case 71 may have an opened front surface and may have an approximately rectangular parallelepiped shape.

The inner cases 70 may further include an inner freezing chamber case 75 defining the freezing chamber 12. The inner freezing chamber case 75 may have an opened front surface and may have an approximately rectangular parallelepiped shape. The inner freezing chamber case 75 may be arranged below the inner refrigerating chamber case 71 to be spaced apart from the inner refrigerating chamber case 71. The inner refrigerating chamber case 71 may be named a "first inner case", and the inner freezing chamber case 75 may be named a "second inner case".

The partition wall 50 may be arranged between the inner refrigerating chamber case 71 and the inner freezing chamber case 75. The partition wall 50 may include a front partition wall part (or first partition wall) 51 defining a front outer appearance of the partition wall 50. When the doors 21 and 22 are opened, the front partition wall 51 may be located between the refrigerating chamber 12 and the freezing chamber 13 when viewed from the outside.

The partition wall 50 may further include the partition wall insulator 55 provided on a rear side of the front partition wall 51 to insulate the refrigerating chamber 12 and the freezing chamber 13. The partition wall insulator 55 may be arranged between a bottom surface of the inner refrigerating chamber case 71 and an upper surface of the inner freezing chamber case 75. The partition wall 50 may include the bottom surface of the inner refrigerating chamber case 71 and the upper surface of the inner freezing chamber case 75.

The refrigerator 10 may include a cold air supplying device (or cold air supply) 100 configured to supply cold air to the refrigerating chamber 12 and the freezing chamber 13. The cold air supply 100 may be arranged below the partition wall insulator 55. The cold air supply 100 may be installed on an inner upper surface of the inner freezing chamber case 75.

The cold air generated by the cold air supply 100 may be supplied to the refrigerating chamber 12 and the freezing chamber 13, respectively. A refrigerating chamber cold air duct 81 through which at least a portion of the cold air generated by the cold air supply 100 flows may be provided on a rear side of the refrigerating chamber 12.

Further, refrigerating chamber cold air supplying parts or ports 82 configured to supply the cold air to the refrigerating chamber 12 may be formed in the refrigerating chamber cold air duct 81. The refrigerating chamber cold air duct 81 may be formed on a rear wall of the refrigerating chamber 12, and the refrigerating chamber cold air supplying ports 82 may be formed on a front surface of the refrigerating chamber cold air duct 81.

The cold air supply 100 may include a freezing chamber cold air supplying unit configured to supply at least a portion of the cold air generated by the cold air supply 100 to the freezing chamber 13. The freezing chamber cold air supplying unit may include a second supply unit (or freezing chamber air supply) 326. Descriptions related thereto will be made with reference to the accompanying drawings.

A machine room 80 may be formed on a lower rear side of the inner freezing chamber case 75. A compressor and an evaporator as components constituting a refrigeration cycle may be installed in the machine room 80.

Figure 4:
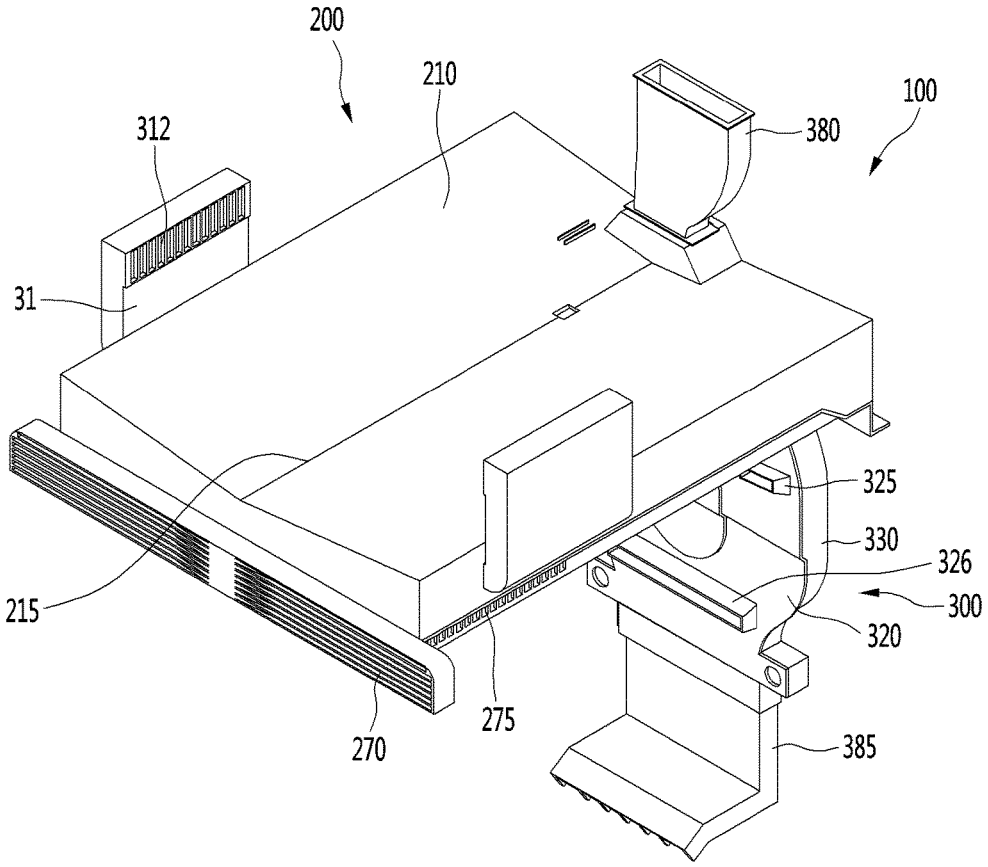
FIG. 4 illustrates a configuration of the cold air supplying device according to the embodiment.
Figure 5:
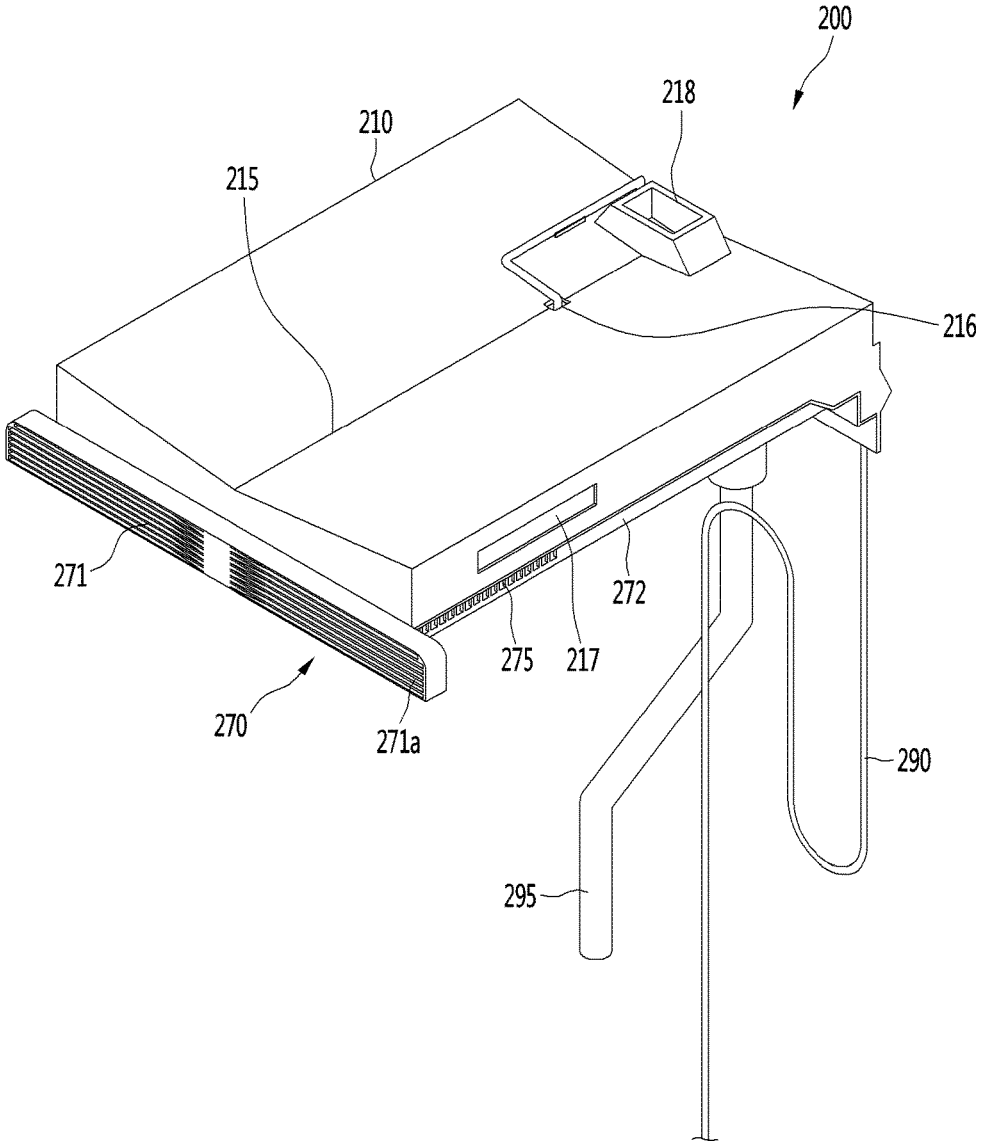
FIG. 5 illustrates a configuration of a cold air generator in the cold air supplying device according to the embodiment.
Figure 6:
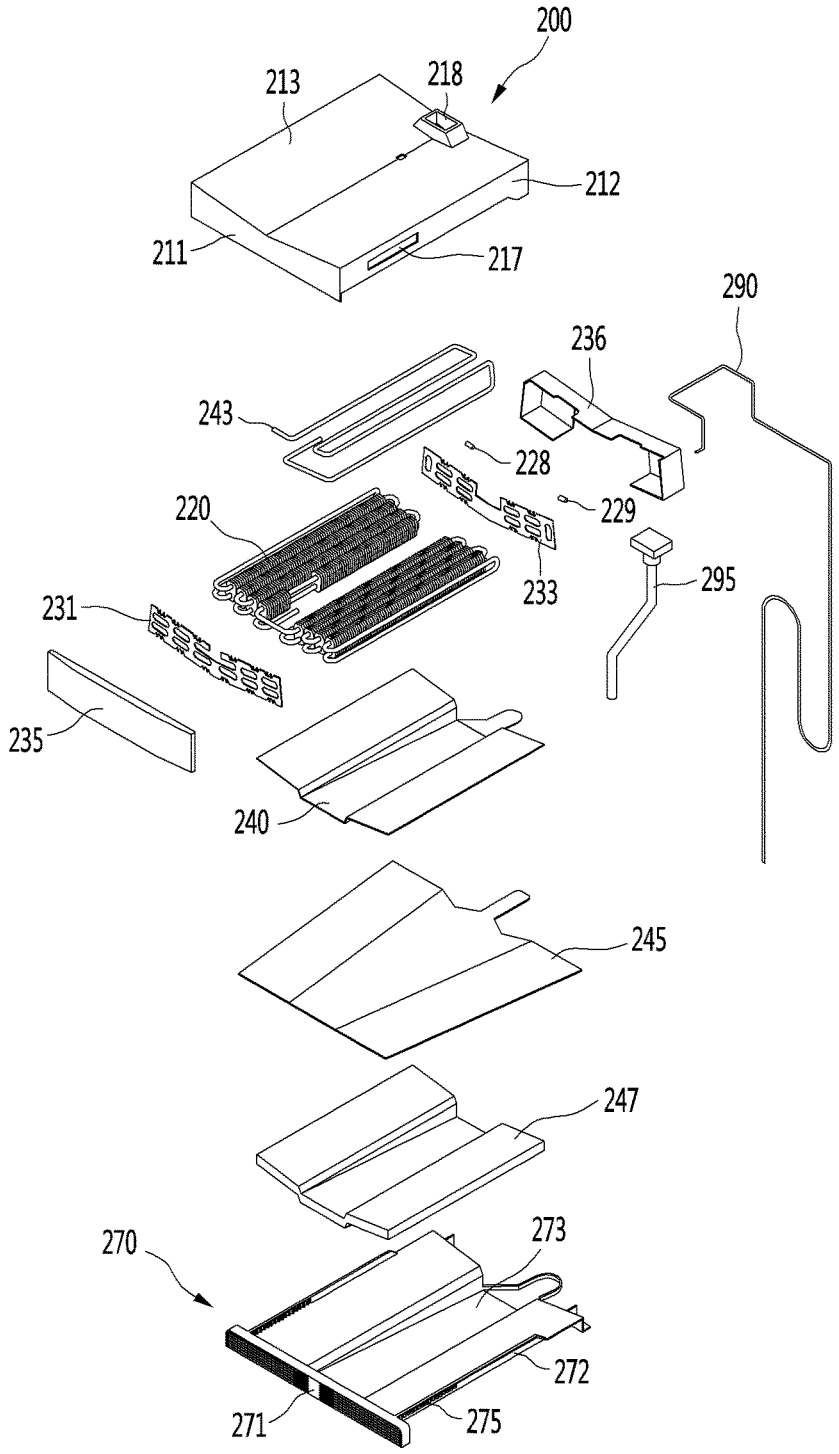
FIG. 6 is an exploded perspective view illustrating the configuration of the cold air generator.

Referring to FIGS. 4 to 6, the cold air supply 100 according to the embodiment may include a cold air generator 200 configured to generate cold air using evaporation heat of refrigerant circulating in the refrigeration cycle and a flow supply unit or device 300 configured to supply the cold air generated by the cold air generator 200 to the storage chambers. The cold air generator 200 may include an evaporator 220 in which the refrigerant is evaporated, a first cover 210 provided above the evaporator 220, and a second cover 270 provided below the evaporator 220. The first cover 210 may be coupled to an upper portion of the second cover 270, and an inner space defined by the first and second covers 210 and 270 may define an installation space in which the evaporator 220 is installed.

Further, the first and second covers 210 and 270 may be named an "evaporator case" accommodating the evaporator 220, and the installation space may be named an "evaporation chamber" or a "heat exchange chamber". The evaporator cases 210 and 270 may be located on the bottom surface of the partition wall 50. The partition wall 50 may insulate the refrigerating chamber 12 from the heat exchange chamber.

Figure 15:
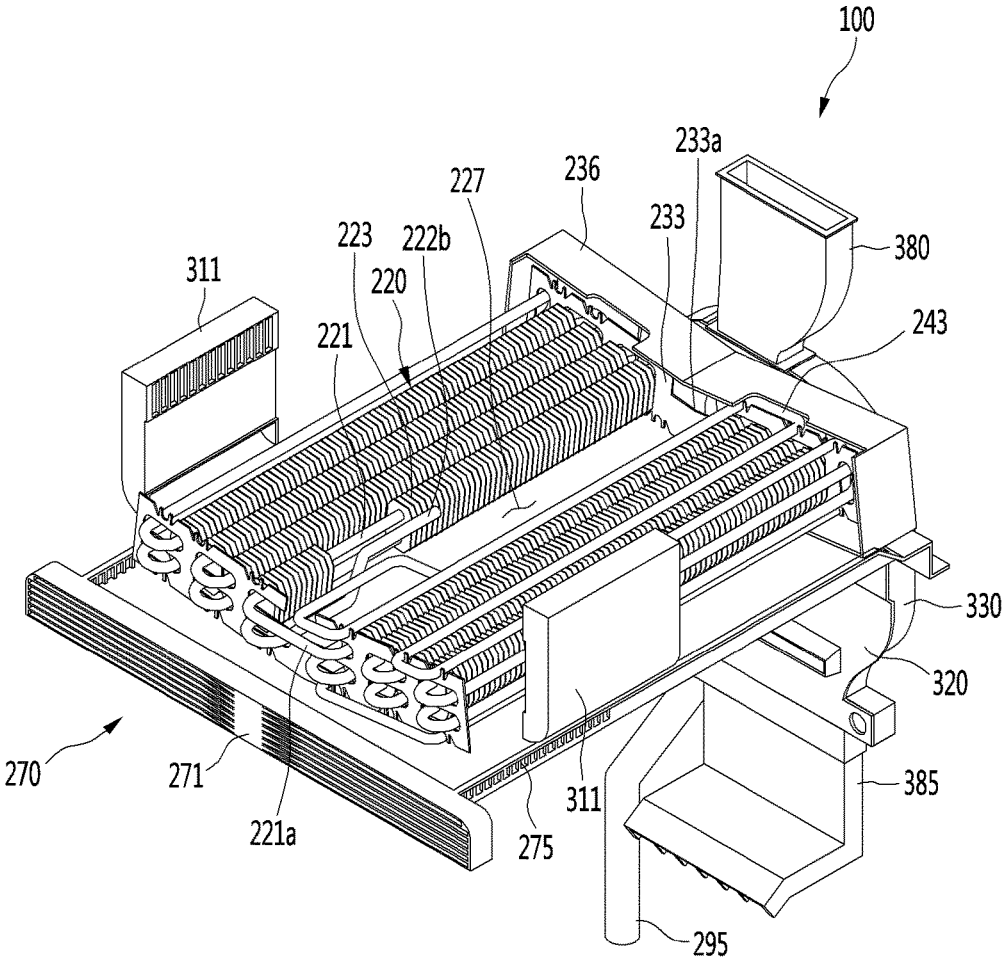
FIG. 15 illustrates an internal configuration of the cold air supplying device according to the embodiment.
Figure 16:
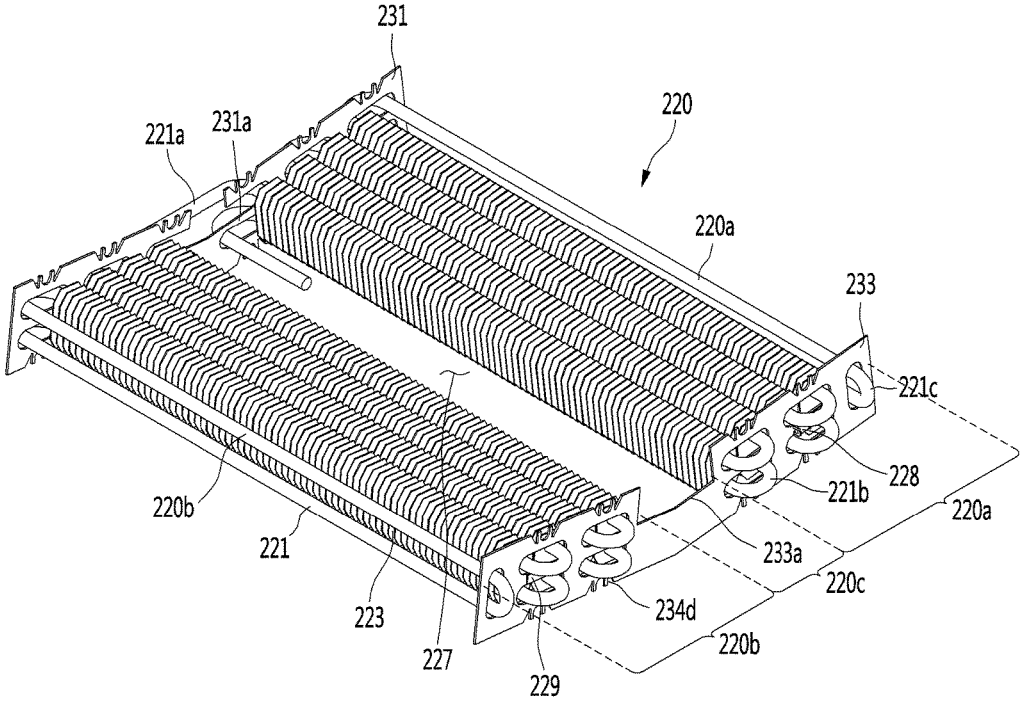
FIG. 16 illustrates a configuration of the evaporator according to the embodiment.
Figure 17:
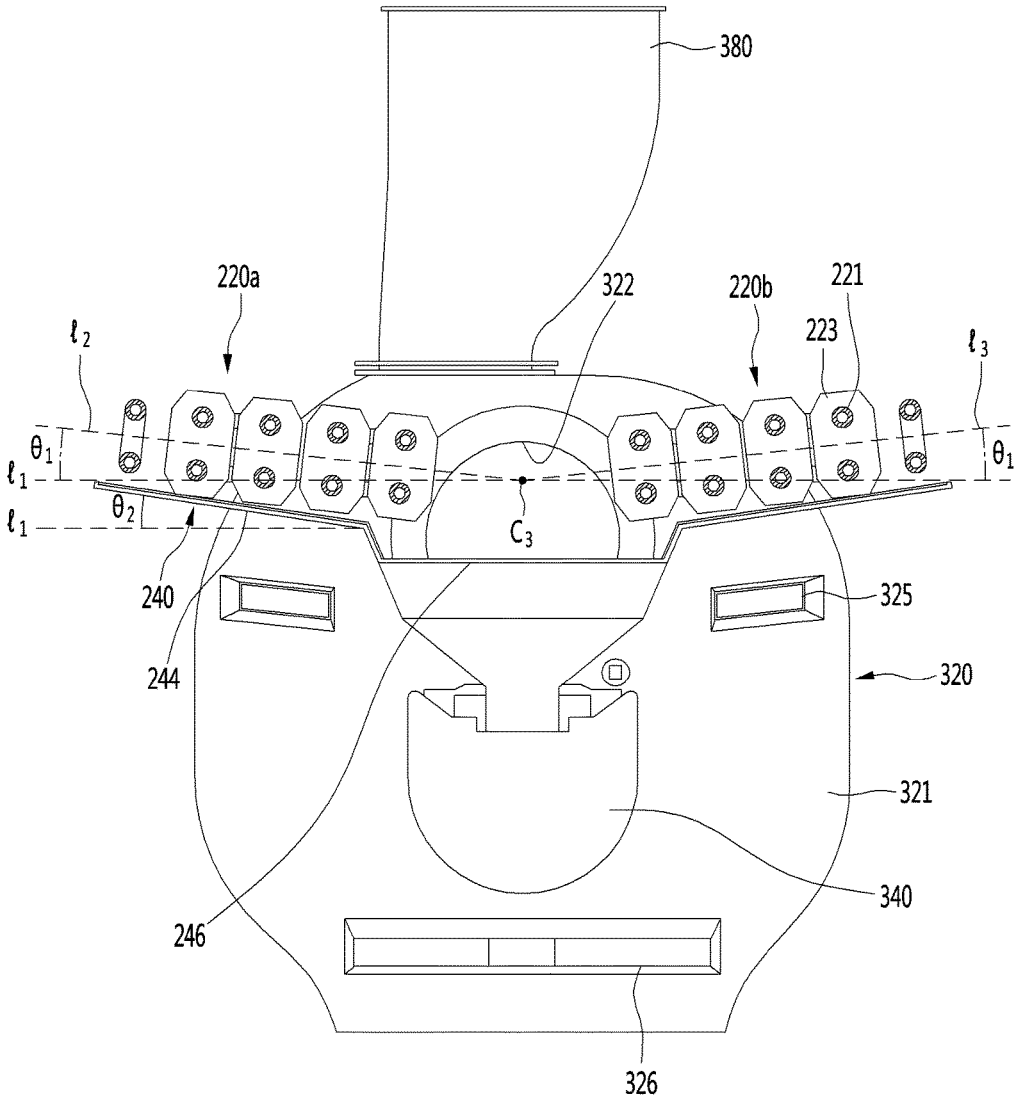
FIG. 17 is a sectional view illustrating configurations of the evaporator and a defrosting water tray according to the embodiment.

The evaporator 220 may include refrigerant pipes 221 through which the refrigerant flows and fins 223 coupled to the refrigerant pipes 221 to increase a heat exchange area for the refrigerant (see FIG. 15). The first cover 210 may form at least a portion of the inner freezing chamber case 75. The first cover 210 may form an inner upper surface of the inner freezing chamber case 75. In other words, the first cover 210 may be formed integrally with the inner freezing chamber case 75 and may be provided on a lower surface of the inner freezing chamber case 75.

The first cover 210 may include a first front cover part (or first front cover) 211 provided in front of the evaporator 220, first side cover parts (or first side covers) 212 extending rearwards from opposite sides of the first front cover part 211, and a first upper cover part (or first upper cover) 213 coupled to upper sides of the opposite first side cover parts 212. A recessed part (or recess) 215 may be formed at a center of the first upper cover 213. The recess 215 may extend from a front side to a rear side of the first upper cover 213.

The first upper cover 213 may be inclined from the recess 215 toward opposite sides of the recess 215. Such a shape may correspond to a shape of the evaporator 220, which may inclined to opposite sides.

Each first side cover 212 may include a first duct coupling part (or first duct coupler) 217 to which a discharge duct 311 of the flow supply device 300 is coupled, which will be described below. As an example, the first duct coupler 217 may be formed in the opposite first side covers 212, respectively. That is, the first duct coupler 217 may be arranged on opposite side surfaces (a left surface and a right surface) of the first cover 210.

The cold air stored in the refrigerating chamber 12 may be discharged through the discharge ducts 311, and the discharged cold air may flow to the inner space defined by the first cover 210 and the second cover 270 via the first duct couplers 217. Further, the cold air may be cooled while passing through the evaporator 220.

The first cover 210 may include a second duct coupling part (or second duct coupler) 218 to which a first supply duct 380 of the flow supply device 300 is coupled. At least a portion of the cold air generated by the evaporator 220 may flow to the first supply duct 380 and may be supplied to the refrigerating chamber 12. The second duct coupler 218 may be provided in the first upper cover 213.

A pipe penetration part or hole 216 through which a suction pipe 290 passes may be formed in the first cover 210. The suction pipe 290, which is a pipe configured to guide the refrigerant evaporated by the evaporator 220 to the compressor, may be connected to the evaporator 220, pass through the pipe penetration hole 216, and extend to the compressor arranged in the machine room 80. The pipe penetration hole 216 may be formed in the recess 215.

The second cover 270, which supports the evaporator 220, may be arranged in the freezing chamber 13. As an example, the second cover 270 may be arranged on a lower side of the inner freezing chamber case 75.

The second cover 270 may include a cover seating part (or cover seat) 273 arranged on a lower side of the evaporator 720 to support the evaporator 220 or a defrosting water tray 240. The cover seat 273 may be from opposite sides toward a central side, to correspond to the inclined shape of the evaporator 220 and the inclined shape of the defrosting water tray 240.

The second cover 270 may further include a second front cover part (or second front cover) 271 provided in front of the cover seat 273. Through-holes 271*a* through which the cold air stored in the freezing chamber 13 may pass may be formed in the second front cover 271. As an example, the through-holes 271*a* may be formed on opposite sides of the second front cover 271 to guide the cold air located on a front side of the freezing chamber 13 such that the cold air may easily flow to cover discharge holes 275. By the formation of the through-holes 271*a*, a flow resistance of the cold air flowing toward the cover discharge holes 275 may be reduced.

The second cover 270 may further include an insulator inserting part or slot 271*b* in which a cover insulator 235 may be installed. The insulator inserting slot 271 may be formed as an upper surface of the second front cover 271 is penetrated (see FIG. 15).

The second cover 270 may further include second side cover parts 9 or second side cover) 272 coupled to opposite sides of the second front cover 271 to extend toward a rear of the refrigerator. Further, the opposite second side covers 272 may be coupled to opposite sides of the cover seat 273 to extend upwards. The first cover 210 may be coupled to upper portions of the second side covers 272.

The cover discharge holes 275 configured to guide the cold air stored in the freezing chamber 13 to the evaporator 220 may be formed in the second side covers 272. As an example, a plurality of holes may be included in the cover discharge holes 275, and the plurality of holes may be arranged from front or first sides toward rear or second sides of the second side covers 272. The cold air in the freezing chamber 13 may flow to the inner space defined by the first and second covers 210 and 270 through the cover discharge holes 275 and may be cooled while passing through the evaporator 220. The first duct couplers 217 and the cover discharge holes 275 may be collectively named "introduction guide parts".

The cold air generator 200 may further include a first heater 243 coupled to the evaporator 220 to supply a predetermined amount of heat to the evaporator 220. The first heater 243, which may be a heater configured to provide an amount of heat for melting ice when frost is generated in the evaporator 220, may be named a "first defrosting heater". As an example, the first heater 243 may be coupled to an upper portion of the evaporator 220.

The cold air generator 200 may further include evaporator supporting devices or support 231, 233 and 236 configured to support the evaporator 220. The evaporator supports 231, 233 and 236 may be located inside the evaporator cases 210 and 270. Further, the evaporator supports 231, 233 and 236 may include evaporator holders 231 and 233 and a supporter 236.

The evaporator holders 231 and 233 may include a first holder 231 supporting a front portion of the evaporator 220 and a second holder 233 supporting a rear portion of the evaporator 220. The first holder 231 may be supported on the defrosting water tray 240 and the second holder 233 may be supported on the supporter 236.

The supporter 236 may be supported on the second cover 270 and may be arranged on a rear side of the evaporator 220. By the configurations of the evaporator holders 231 and 233 and the supporter 236, the evaporator 220 may be stably supported inside the space defined by the first and second covers 210 and 270.

The cold air generator 200 may further include a defrosting sensor 228 configured to detect the temperature near the evaporator 220 to determine a defrosting start time or a defrosting termination time of the evaporator 220. The defrosting sensor 228 may be installed in the evaporator holders 231 and 233, for example, the second holder 233.

The cold air generator 200 may further include a fuse 229 configured to interrupts current applied to the first heater 243. When the temperature of the evaporator 220 is not less than a predetermined temperature, the current supplied to the first heater 243 may be interrupted when the fuse 229 is cut, so that a safety accident may be prevented. The fuse 229 may be installed in the evaporator holders 231 and 233, for example, the second holder 233.

The cold air generator 220 may further include evaporator insulators 235 and 247 configured to perform insulation between the heat exchange area formed near the evaporator 220 and a space outside the heat exchange area. The evaporator insulators 235 and 247 may include a cover insulator 235 arranged on a front side of the first holder 231 to insulate a front space of the evaporator 220.

The evaporator insulators 235 and 247 may also include a tray insulator 247 supported by the second cover 270. The tray insulator 247 may be arranged below the defrosting water tray 240 to insulate a lower space of the evaporator 220. The tray insulator 247 may be seated on the cover seat 273 of the second cover 270 and may be positioned below the second heater 245. In particular, the tray insulator 247 may prevent heat generated by the second heater 245 from being applied to the freezing chamber 13.

The cold air generator 220 may further include the defrosting water tray 240 arranged below the evaporator 220 to collect the defrosting water generated by the evaporator 220. The defrosting water tray 240 may be shaped to be recessed from opposite sides toward a central portion of the defrosting water tray 240 to correspond to the shape of the evaporator 220. Thus, the defrosting water generated by the evaporator 220 may be stored in the defrosting water tray 240 and may flow to the central portion of the defrosting water tray 240.

In a spaced distance between the defrosting water tray 240 and the evaporator 220, a distance between the evaporator 220 and the central portion of the defrosting water tray 240 may be larger than distances between the evaporator 220 and the opposite sides of the defrosting water tray 240. In other words, the spaced distance between the defrosting water tray 240 and the evaporator 220 may be gradually increased from opposite sides toward central portions of the evaporator 220 and the defrosting water tray 240. According to such a configuration, even when an amount of the defrosting water flowing to the central portion of the defrosting water tray 240 is increased, the defrosting water does not contact the surface of the evaporator 220, so that the frost in the evaporator 220 may be prevented.

The cold air generator 200 may further include a second heater 245 arranged below the defrosting water tray 240 to supply a predetermined amount of heat to the defrosting water tray 240. The second heater 245, which may provide an amount of heat to melt ice when frost is generated in the defrosting water tray 240, may be named a "second defrosting heater". The second heater 245 may be arranged between the defrosting water tray 240 and the tray insulator 247.

As an example, the second heater 245 may include a surface-shaped heater having a shape of a plate or a panel. The second heater 245 may be provided on the bottom surface of the defrosting water tray 240, and thus the defrosting water flowing on the upper surface of the defrosting water tray 240 may not be disturbed by the second heater, so that the defrosting water may be easily discharged. Further, the defrosting water may not be applied to the surface of the second heater 245, so that a phenomenon in which the second heater 245 is corroded or malfunctioned by the defrosting water may be prevented.

The cold air generator 200 may further include a drain pipe 295 configured to discharge the defrosting water collected in the defrosting water tray 240 from the defrosting water tray 240. The drain pipe 295 may be arranged on a rear side of grill covers 320 and 330, which will be described below. Further, the drain pipe 295 may be connected to a rear side of the defrosting water tray 240, extend downwards, and communicate with the machine room 80. The defrosting water may flow through the drain pipe 295 to be introduced into the machine room 80, and may be collected in a drain fan provided in the machine room 80.

Figure 7:
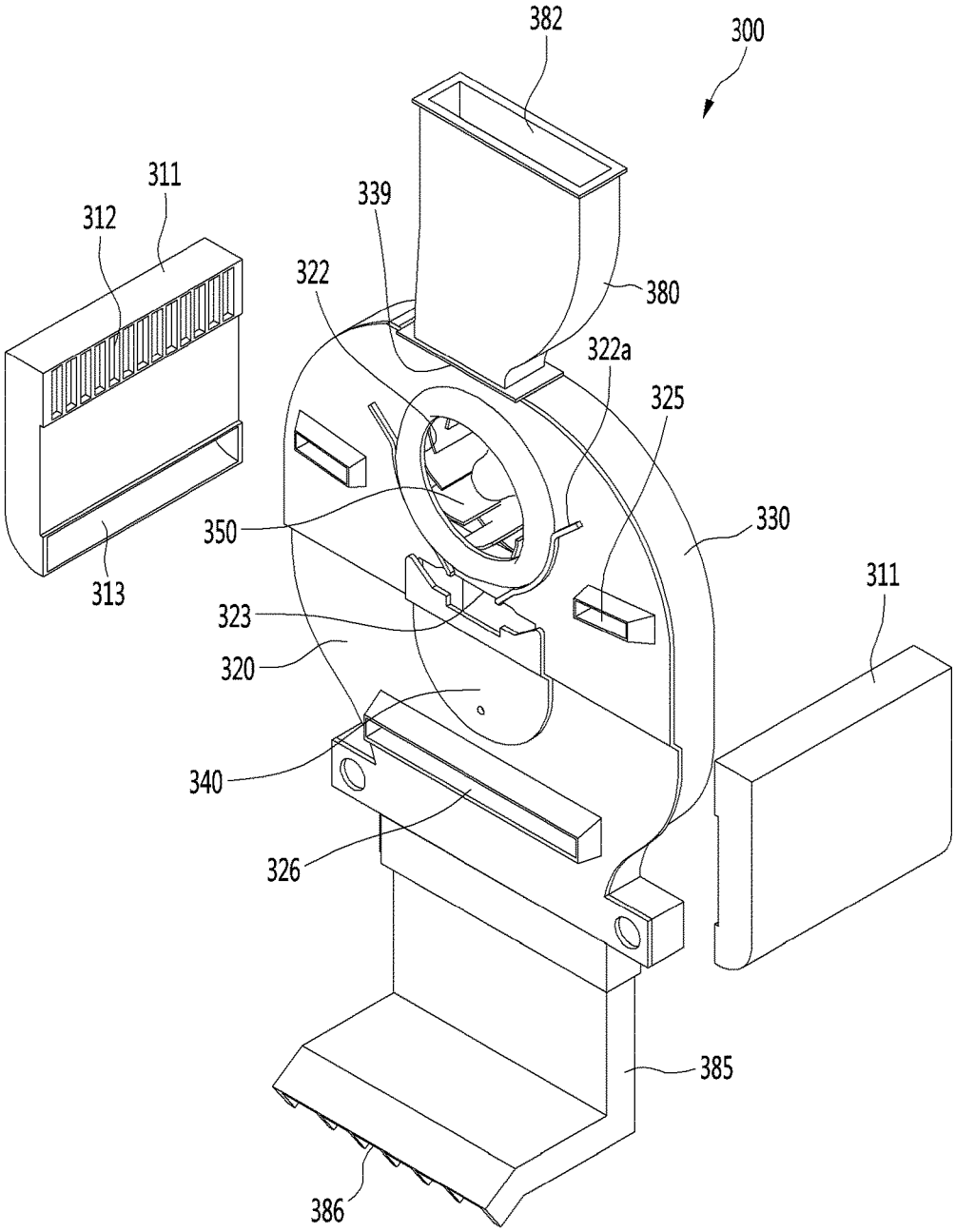
FIG. 7 illustrates a configuration of a flow supply device in the cold air supplying device according to the embodiment.
Figure 8:
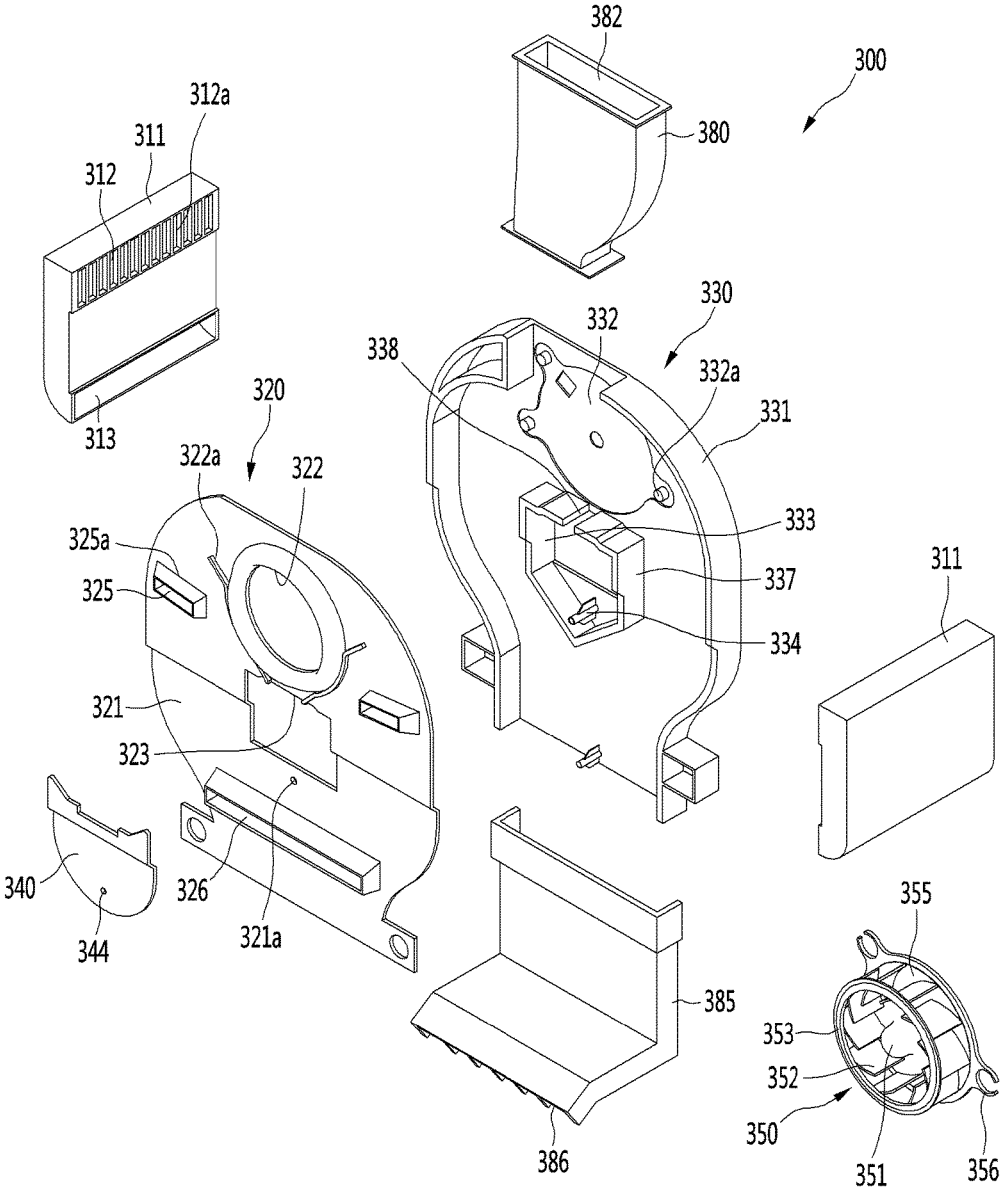
FIG. 8 is an exploded perspective view illustrating the configuration of the flow supply device.
Figure 9:
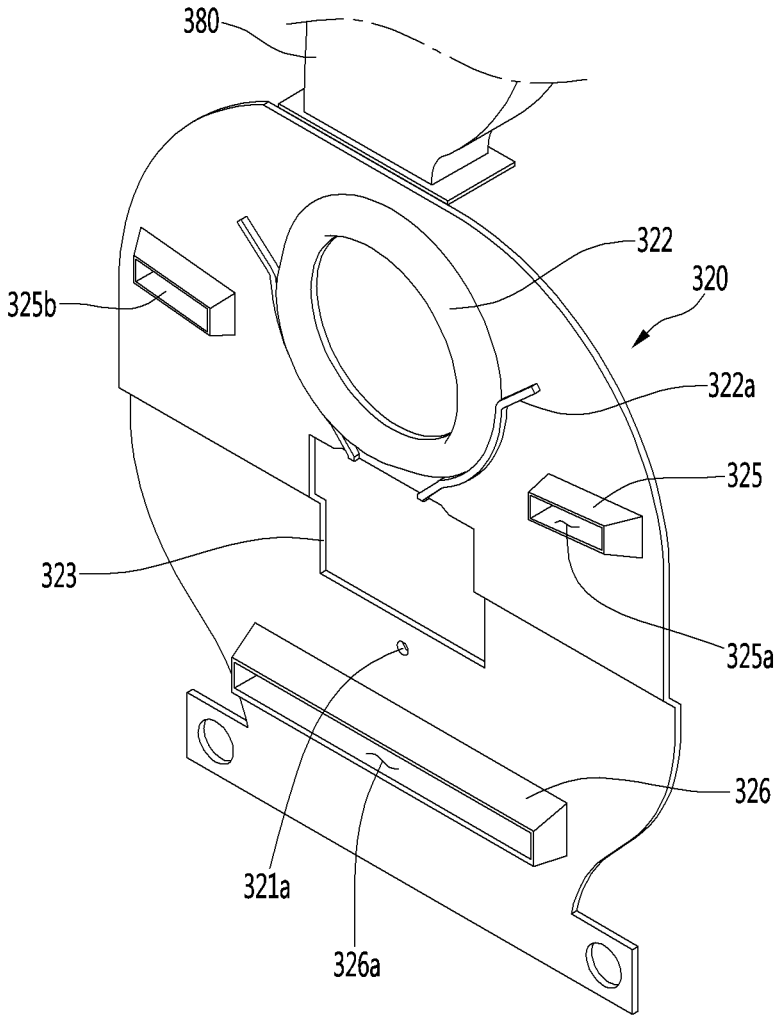
FIG. 9 is a front perspective view illustrating a configuration of a first grill cover according to the embodiment.
Figure 10:
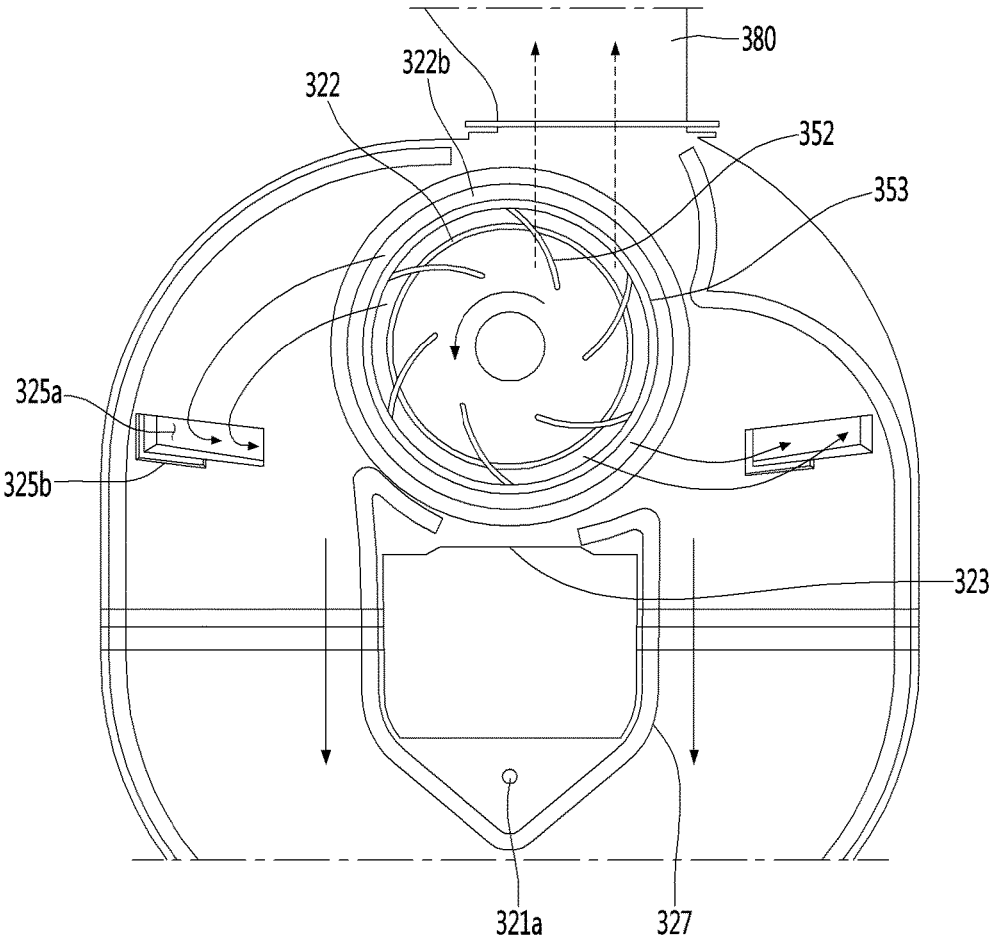
FIG. 10 is a rear view illustrating the configuration of the first grill cover according to the embodiment.

Referring to FIGS. 7 and 8, the flow supply device 300 according to the embodiment may include fan assemblies 350 and 355 configured to generate flow of the cold air. The fan assemblies 350 and 355 may include a blowing fan 350. As an example, the blowing fan 350 may include a centrifugal fan by which the cold air is introduced in an axial direction and is discharged in a circumferential direction. The cold air flowing through a refrigerating chamber suction passage and the cold air flowing through a freezing chamber suction passage may be combined with each other and the combined cold air may be introduced into the blowing fan 350.

The blowing fan 350 may include a hub 351 to which a fan motor is coupled, a plurality of blades arranged on an outer peripheral surface of the hub 351, and a bell mouth 353 coupled to front ends of the plurality of blades 352 to guide the cold air such that the cold air is introduced into the blowing fan 350. The blowing fan 350 may be installed in an inner space between the grill covers 320 and 330. The blowing fan 350 may be seated on a fan seating part (or fan seat) 332 provided in the grill covers 320 and 330. The fan seat 332 may be provided in the second grill cover 330.

The fan assemblies 350 and 355 may further include a fan support 355 coupled to the blowing fan 350 to allow the blowing fan 350 to be supported on the grill covers 320 and 330. The fan support 355 may include cover supports 356 coupled to support coupling parts (or support couplers) 332*a* of the fan seat 332. The plurality of cover supports 356 may be formed along a circumference of the fan support 355.

The flow supply device 300 may further include the grill covers 320 and 330 defining an installation space (hereinafter, referred to as a fan installing space) in which the fan assemblies 350 and 355 are installed. The grill covers 320 and 330 may be located on a rear side of the freezing chamber 13, that is, on a rear surface of the inner freezing chamber case 75.

The grill covers 320 and 330 may include a first grill cover 320 and a second grill cover 330 coupled to a rear side of the first grill cover 320. The installation space may be defined as an inner space defined by coupling the first and second grill covers 320 and 330 to each other.

The first grill cover 320 may include a first grill cover body 321 having a shape of a plate and a fan suction part or port 322 formed in the first grill cover body 321 to guide the cold air heat-exchanged by the evaporator 220 such that the cold air flows to the blowing fan 350. As an example, the fan suction port 322 may be formed at an upper portion of the first grill cover body 321 and may have an approximately circular shape. The air passing through the evaporator 220 may be introduced into the fan installing space via the fan suction port 322.

Condensed water guides 322*a* configured to guide the condensed water generated around the fan suction part 322, that is, the condensed water generated in the grill covers 320 and 330 or the blowing fan 350 to a lower side may be provided outside the fan suction part 322. The condensed water guides 322*a* may be provided on a front surface of the first grill cover body 321. As an example, the condensed water guides 322*a* may extend toward the fan suction port 322 from an outer portion of the first grill cover body 321 and may be rounded along an edge of the fan suction part 322. Further, lower ends of the condensed water guides 322*a* may be connected to a first cover inserting part 323.

The first grill cover body 321 may further include the first cover inserting hole 323 into which the second cover 270 or the defrosting water tray 240 of the cold air generator 200 is inserted. Further, the second grill cover body 330 may include a second cover inserting part or hole 333 into which the second cover 270 or the defrosting water tray 240 of the cold air generator 200 is inserted.

The second cover 270 or the defrosting water tray 240 may extend to the inner space between the grill covers 320 and 330 through the first cover inserting hole 323 and extend to a rear side of the grill covers 320 and 330 through the second cover inserting hole 333. Further, the second cover 270 or the defrosting water tray 240 may be connected to the drain pipe 295 and the defrosting water stored in the defrosting water tray 240 may be introduced into the drain pipe 295 (see FIG. 22).

The flow supply device 300 may further include a sub-cover 340 configured to shield at least a portion of the first cover inserting part 323. As an example, the sub-cover 340 may shield a lower space of the first cover inserting hole 323 and the second cover 270 or the defrosting water tray 240 may be inserted into an upper space of the first cover inserting hole 323. In a simple description of an assembling process, after the second cover 270 and the defrosting water tray 240 are inserted into the first cover inserting hole 323, the sub-cover 340 may be assembled with the first cover inserting hole 323.

A coupling hole 344 may be formed in the sub-cover 340. The coupling hole 344 may be coupled to a sub-cover coupling part or boss 334 of the second grill cover 330 by a specific fastening member. In this case, the fastening member may be coupled to the sub-cover coupling boss 334 by passing through a first fastening hole 321*a* of the first grill cover 320. The first fastening hole 321*a* may be located below the first cover inserting part 323.

The first grill cover 320 may include a plurality of cold air supplying parts or ports 325 and 326 configured to discharge the cold air passing through the blowing fan 350 to the freezing chamber 13. The plurality of cold air supplying ports 325 and 326 include first supply parts or ports 325 formed at upper portions of the first grill cover body 321. The plurality of first supply ports 325 may be arranged on opposite sides of the fan suction port 322, and may be located above the first cover inserting hole 323. The first supply ports 325 may supply the cold air toward an upper space of the freezing chamber 13.

As an example, the first supply ports 325 may supply the cold air toward the lower surface of the cold air generator 200, that is, the bottom surface of the second cover 270. Dew may be generated on an outer surface of the second cover 270 due to a difference between the internal temperature of the second cover 270 and the internal temperature of the freezing chamber 13. A larger amount of dew may be generated when the freezing chamber door 22 is opened, and thus humid and hot air may be introduced into the freezing chamber 13.

The cold air supplied through the first supply ports 325 flows toward the second cover 270, so that the dew may be evaporated or the frost existing in the second cover 270 may be removed. To achieve this, the first supply ports 325 may be arranged at locations lower than the bottom surface of the second cover 270.

The plurality of cold air supplying ports 325 and 326 may further include a second supply part or port 326 formed at a lower portion of the first grill cover body 321. The second supply port 326 may be located below the first cover inserting hole 323 and may supply the cold air toward a central space or a lower space of the freezing chamber 13.

The second grill cover 330 may be coupled to a rear side of the first grill cover 320. The second grill cover 330 may include a second grill cover body 331 having a shape of a plate. The second grill cover body 331 may include the fan seat 332 having the support couplers 332*a* coupled to the fan supports 355. The fan seat 322 may be provided at an upper portion of the second grill cover 330, and may be arranged at a location corresponding to the fan suction port 322 of the first grill cover 320.

The second grill cover 330 may further include a protrusion 337 protruding forwards from the second grill cover body 331. The protrusion 337 may support a rear surface of the first grill cover 320 and surround the second cover inserting hole 333.

An upper surface of the protrusion 337 may function as a water collector that collects the condensed water generated inside the blowing fan 350 or the grill covers 320 and 330. Further, a condensed water hole 338 through which the condensed water generated by the blowing fan 350 is discharged to a lower side may be formed on the upper surface of the protrusion 337. While the cold air flows through the blowing fan 350, the condensed water may be generated around the fan assemblies 350 and 355. Further, the condensed water may be collected to the upper surface of the protrusion 337 and may fall down to the defrosting water tray 240 through the condensed water hole 338.

The condensed water hole 338 may be located on an upper side of the second cover inserting hole 333 and the defrosting water tray 240 may pass through the second cover inserting hole 333, so that the defrosting water falling down through the condensed water hole 338 may be collected in the defrosting water tray 240. According to such a configuration, the condensed water generated by the fan assemblies 350 and 355 may be easily discharged.

The flow supply device 300 may further include discharge ducts 311 coupled to the evaporator cases 210 and 270 to guide the cold air stored in the refrigerating chamber 12 to insides of the evaporator cases 210 and 270, that is, toward the evaporator 220. The discharge ducts 311 may be coupled to the inner refrigerating chamber case 71 to extend downward, and may be coupled to the evaporator cases 210 and 270.

Discharge holes 312 which communicate with the refrigerating chamber 12 and into which the cold air in the refrigerating chamber 12 is introduced may be formed at upper portions of the discharge ducts 311. A plurality of first grills 312*a* may be provided in the discharge holes 312 to prevent foreign substances existing in the refrigerating chamber 12 from being introduced into the discharge ducts 311 through the discharge holes 312. The discharge holes 312 may be spaces formed between the plurality of first grills 312*a*.

Evaporator supply parts or ports 313 coupled to the evaporator cases 210 and 270 to introduce the cold air discharged from the refrigerating chamber 12 into the installation space for the evaporator 220 may be formed at lower portions of the discharge ducts 311. As an example, the evaporator supply ports 313 may be coupled to the first duct coupling parts 217 of the first cover 210.

The discharge ducts 311 may be provided on opposite sides of the evaporator cases 210 and 270. Thus, the cold air stored in the refrigerating chamber 12 may be discharged to opposite sides of the inner refrigerating chamber case 71 and may be supplied to the insides of the evaporator cases 210 and 270 through the discharge ducts 311. Further, the supplied cold air may be cooled while passing through the evaporator 220.

The flow supply device 300 may further include a first supply duct 380 through which at least a portion of the air passing through the blowing fan 350 flows. As an example, the first supply duct 380 may guide a flow of the cold air to be supplied to the refrigerating chamber 12.

The grill covers 320 and 330 may include a refrigerating chamber supply part or port 339 communicating with the first supply duct 380. The refrigerating chamber supply port 339 may be formed by coupling the first grill cover 320 and the second grill cover 330 to each other.

Further, the refrigerating chamber supply port 339 may be coupled to the second duct coupler 218 of the first cover 210. That is, a rear portion of the first cover 210 may be coupled to upper portions of the grill covers 320 and 330 and the second duct coupler 218 and the refrigerating chamber supply port 339 may be vertically aligned to communicate with each other. Thus, the cold air passing through the blowing fan 350 may flow to the first supply duct 380 through the refrigerating chamber supply port 339 of the grill covers 320 and 330 and the second duct coupler 218 of the first cover 210.

A duct connector 382 connected to the refrigerating chamber cold air duct 81 may be formed at an upper portion of the first supply duct 380. Thus, the cold air flowing through the first supply duct 380 may be introduced into the refrigerating chamber cold air duct 81 to flow upwards and may be supplied to the refrigerating chamber 12 through the refrigerating chamber cold air supplying ports 82.

The flow supply device 300 may further include a second supply duct 385 which is coupled to a lower side of the grill covers 320 and 330 and through which at least a portion of the cold air passing through the blowing fan 350 may flow. As an example, the second supply duct 385 may guide a flow of the cold air to be supplied to the freezing chamber 13. Further, a third supply part or port 386 through which the cold air is discharged to the freezing chamber 13 may be formed at a lower portion of the second supply duct 385.

A portion of the cold air passing through the blowing fan 350 may flow upward and may be supplied to the refrigerating chamber 12 through the first supply duct 380. Further, the remaining cold air may flow to opposite sides of the blowing fan 350, and a portion of the remaining cold air may be supplied to an upper space of the freezing chamber 13 through the plurality of first supply ports 325.

The cold air not supplied through the first supply ports 325 may further flow downwards, and may be supplied to a central space of the freezing chamber through the second supply port 326. Further, the cold air not supplied through the second supply port 326 may further flow downwards, may be introduced into the second supply duct 385, and may be supplied to a lower space of the freezing chamber 13 through the third supply port 386.

Referring to FIGS. 9 to 14, the first grill cover 320 may include the first grill cover body 321 having a front surface and a rear surface. The front surface of the first grill cover body 321, which is a surface viewed in FIG. 9, may be a surface facing a front side of the refrigerator 10, and the rear surface of the first grill cover 321, which is a surface viewed in FIG. 10, may be a surface facing the second grill cover 330.

The first grill cover body 321 may include the plurality of holes 322, 325 and 326 through which the air passes. The plurality of holes 322, 325 and 326 may include the fan suction port 322 configured to guide air flowing from the front side to the rear side, and a plurality of cold air supplying ports configured to guide air flowing from the rear side to the front side. The fan suction port 322 may guide the air cooled by the evaporator 220 located on a front side of the fan suction port 322 such that the air may flow to a rear side of the first grill cover 320 to a fan installing space.

The plurality of cold air supplying ports 325 and 326 may include the first supply ports 325 located on opposite lower sides of the fan suction port 322 and the second supply port 326 spaced apart from the first supply ports 325. The first supply ports 325 may cool an upper space of the freezing chamber 13 and discharge the air toward the bottom surface of the second cover 270. Further, the second supply port 326 may cool a central space or a lower space of the freezing chamber 13.

The first supply ports 325 may protrude from the front surface of the first grill cover body 321 by a predetermined length. Further, the first supply ports 325 may have an approximately rectangular shape. According to such a protruding shape of the first supply ports 325, the air supplied through the first supply ports 325 may flow while being concentrated on the front side of the first grill cover body 321. Further, the first supply ports 325 may define first cold air supplying holes 325*a*. The first cold air supplying holes 325*a*, which may be inner spaces of the protruding first supply ports 325, may be formed by penetrating at least portions of the first grill cover body 321.

Supply guide ribs 325*b* configured to guide flow of the air to pass through the first cold air supplying hole 325*a* may be provided on a rear side of the first supply ports 325. The supply guide ribs 325*b* may protrude rearward from the rear surface of the first grill cover body 321 by a predetermined length. According to the configurations of the supply guide ribs 325*b*, the air passing through the blowing fan 350 may be easily supplied to the first cold air supplying holes 325*a*.

Figure 14:
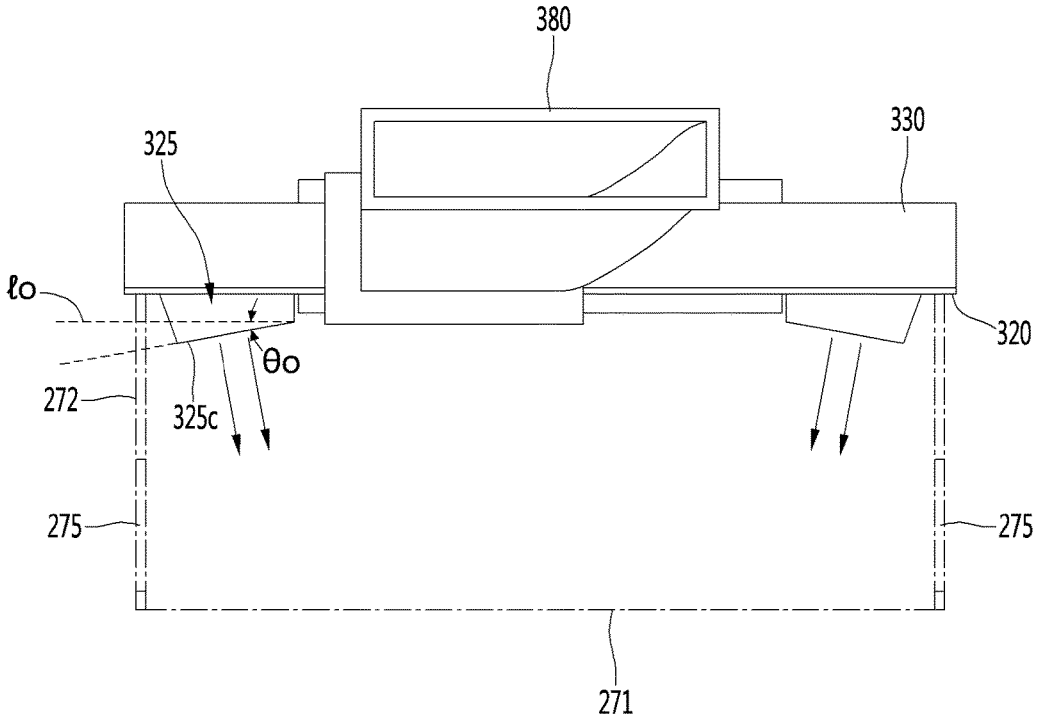
FIG. 14 is a plan view illustrating a configuration of the cold air supplying port according to the embodiment.

Referring to FIG. 14, the first supply ports 325 may be closer to a central portion of the cover grills 320 and 330 than the cover discharge holes 275 provided in the second cover 270. That is, the cover discharge holes 275 may be located laterally outside of the first supply ports 325.

Further, front surfaces 325*c* of the first supply ports 325 may intersect a transverse reference line Io. The front surfaces 325*c* of the first supply ports 325 may be inclined by a setting angle θo with respect to the reference line Io. In other words, the first supply ports 325 provided on opposite sides of the grill covers 320 and 330 may protrude to be inclined from a front surface of the first grill cover 320 to face the central portion of the grill covers 320 and 330. According to such configurations of the first supply ports 325, the air discharged through the first supply ports 325 may be discharged to a front central portion of the grill covers 320 and 330, and the cover discharge holes 275 may be arranged on opposite sides of the second cover 270, so that the cold air discharged from the first supply ports 325 may be prevented from being directly sucked to the cover discharge holes 275.

The second supply port 326 may protrude from the front surface of the first grill cover body 321 by a predetermined length. Further, the second supply port 326 may have an approximately rectangular shape, and may extend in a transverse direction. According to such a protruding shape of the second supply port 326, the cold air supplied through the second supply port 326 may flow while being concentrated on the front side of the first grill cover body 321. Further, the second supply port 326 may define a second cold air supplying hole 326*a*. The second cold air supplying hole 326*a*, which may be an inner space of the protruding second supply port 326, may be formed by penetrating at least a portion of the first grill cover body 321.

The first grill cover body 321 may include the first cover inserting hole 323 through which water passes. The first cover inserting hole 323 may be a penetration hole through which at least a portion of the first grill cover body 321 passes. The first cover inserting hole 323 may be located between the first and second supply ports 325 and 326. That is, the first cover inserting hole 323 may be located on an upper side of the second supply port 326 and on a lower side of the first supply ports 325.

The condensed water guides 322*a* curvedly extending from an outside of the fan suction port 322, extending downwards from opposite sides of the fan suction port 322, and connected to the first cover inserting hole 323 may be provided on a front surface of the first grill cover body 321. The condensed water falling down along the condensed water guides 322*a* may fall down to the defrosting water tray 240 inserted into the first cover inserting hole 323.

A cover support rib 327 arranged outside the first cover inserting hole 323 may be provided on a rear surface of the first grill cover body 321. The cover support rib 327 may surround at least a portion of the first cover inserting hole 323. Further, the cover support rib 327 may be supported by the protrusion 337 of the second grill cover 330.

A shroud 322*b* rotatably supporting the bell mouth 353 of the blowing fan 350 may be formed on the rear surface of the first grill cover body 321. The shroud 322*b* may be formed at an edge of the fan suction port 322 and may be recessed into the rear surface of the first grill cover body 321. At least a portion of the bell mouth 353 may be inserted into the shroud 322*b*.

When the blowing fan 350 is rotated, the cold air sucked through the fan suction port 322 may be introduced in an axial direction of the blowing fan 350 and may be guided along the plurality of blades 352. Further, the air passing through the plurality of blades 352 may be branched into and flow through a refrigerating chamber discharge passage and a freezing chamber discharge passage.

The refrigerating chamber discharge passage may include the first supply duct 380. Some branched air among the air may flow through the first supply duct 380 and may be supplied to the refrigerating chamber 12 through the refrigerating chamber cold air duct 81 and the refrigerating chamber cold air supplying ports 82.

The freezing chamber discharge passage may include the first supply ports 325, the second supply port 326 and the second supply duct 385. The remaining air among the air supplied to the refrigerating chamber 12 may be branched into and flow through the first and second supply ports 325 and 326 and the second supply duct 385. Some air among the air passing through the blowing fan 350 may be supplied to the freezing chamber 13 through the first supply ports 325. Further, some air may be supplied to the freezing chamber 13 through the second supply port 326. Further, the remaining air may flow to the second supply duct 385 and may be supplied to the freezing chamber 13 through the third supply port 386.

Passages extending to the freezing chamber 13 through the first supply ports 325 may be named "first discharge passages", a passage extending to the freezing chamber 13 through the second supply port 326 may be named a "second discharge passage", and a passage extending to the freezing chamber 13 through the second supply duct 385 may be named a "third discharge passage". The second grill cover 330 may include the second grill cover body 331 having a front surface and a rear surface. The front surface of the second grill cover body 331, which is a surface viewed in FIG. 11, may be a surface facing a front side of the refrigerator 10, and the rear surface of the second grill cover 331 may be a surface that is opposite to the front surface.

The protrusion 337 may protrude from the front surface of the second grill cover body 331 and may be located below the fan suction port 332. Further, the protrusion 337 may surround the second cover inserting hole 333.

The condensed water hole 338 through which the condensed water f2 generated by the fan seat 332 or the blowing fan 350 is discharged to the lower side may be formed at an upper portion of the protrusion 337. The condensed water hole 338 may be formed at an approximately central portion of the protrusion 337 and at least a portion of the upper surface of the protrusion 337 may be cut.

Figure 11:
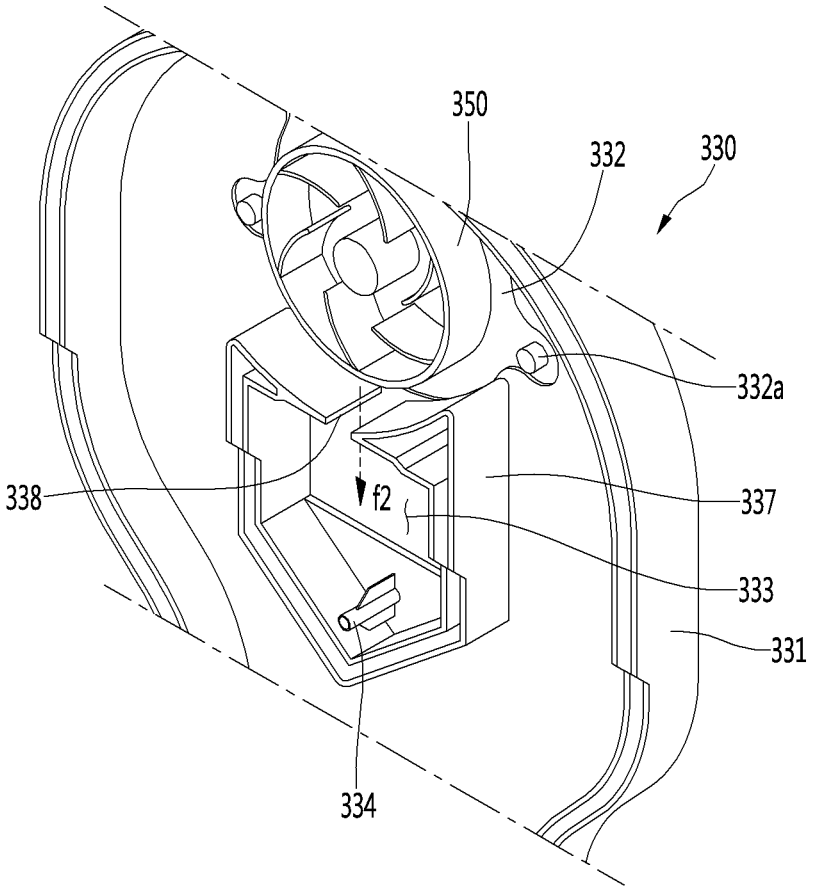
FIG. 11 is a front perspective view illustrating a configuration of a second grill cover according to the embodiment.
Figure 12:
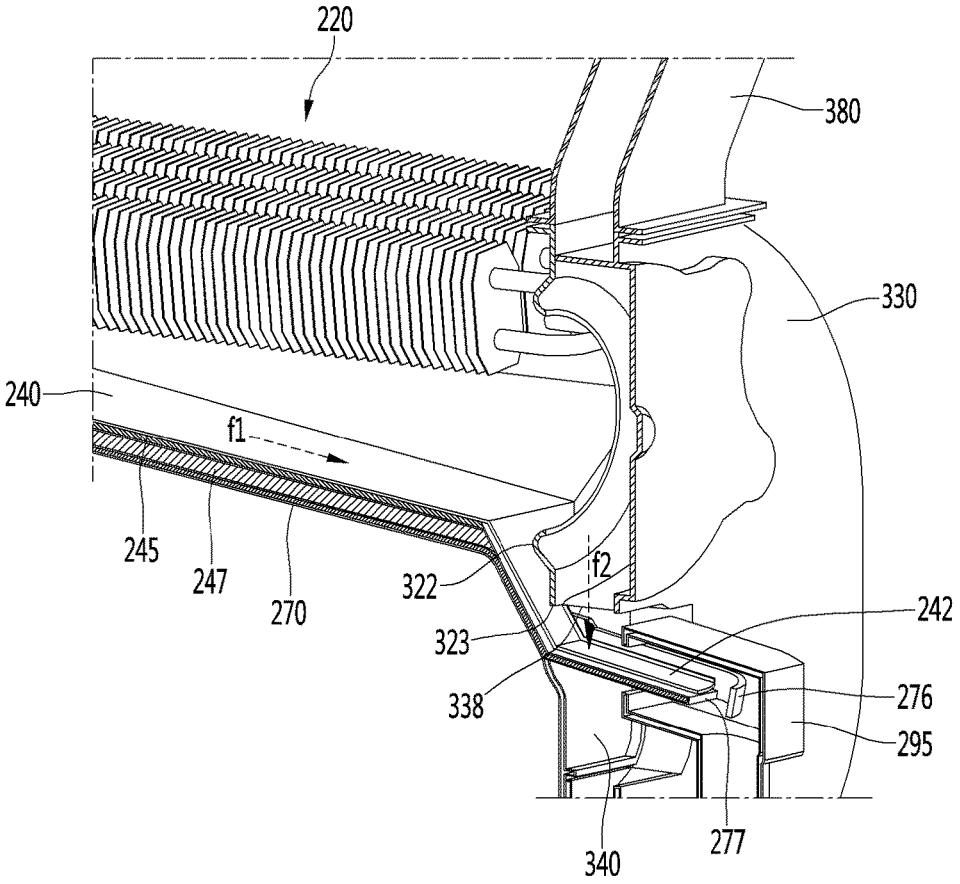
FIG. 12 is a sectional view illustrating a state in which the evaporator, the defrosting water tray, and the grill covers are coupled to each other according to the embodiment.

Referring to FIGS. 11 and 12, the cover inserting holes 323 and 333 into which the defrosting water tray 240 and the second cover 270 are inserted may be formed in the grill covers 320 and 330. The defrosting water tray 240 and the second cover 270 may extend from a front side to a rear side of the grill covers 320 and 330, may pass through the cover inserting holes 323 and 33, and may extend towards the rear side of the grill covers 320 and 330. Further, rear portions of the defrosting water tray 240 and the second cover 270 may communicate with the drain pipe 295.

A first discharge guide 242 configured to discharge the condensed water or the defrosting water to the drain pipe 295 may be formed on a rear side of the defrosting water tray 240. The first discharge guide 242 may be located below the condensed water hole 338. Thus, the condensed water discharged through the condensed water hole 338 may fall down to the first discharge guide 242.

Further, a second discharge guide 276 may be formed on a rear side of the second cover 270. The shape of the second discharge guide 276 may correspond to the shape of the first discharge guide 242, and may support the first discharge guide 242.

At least portions of the first and second discharge guides 242 and 276 may be inserted into the drain pipe 295. To achieve this, the widths of the first and second discharge guides 242 and 276 may be smaller than a diameter of an inlet of the drain pipe 295.

A discharge hole 277 through which water flowing through the first discharge guide 242 is discharged to the drain pipe 295 may be formed in the second cover 270. The discharge hole 277 may be formed on a rear side of the second discharge guide 276.

According to such a configuration, the condensed water or the defrosting water f1 generated by the evaporator 220 may fall down onto the upper surface of the defrosting water tray 240, may flow rearward along the inclined defrosting water tray 240, and may be introduced into the drain pipe 295 through the cover inserting holes 323 and 333. Further, the condensed water generated by the blowing fan 350 or in the grill covers 320 and 330 may fall down onto the upper surface of the defrosting water tray 240 through the condensed water hole 338 and may be introduced into the drain pipe 295 through the discharge hole 277.

Figure 13:
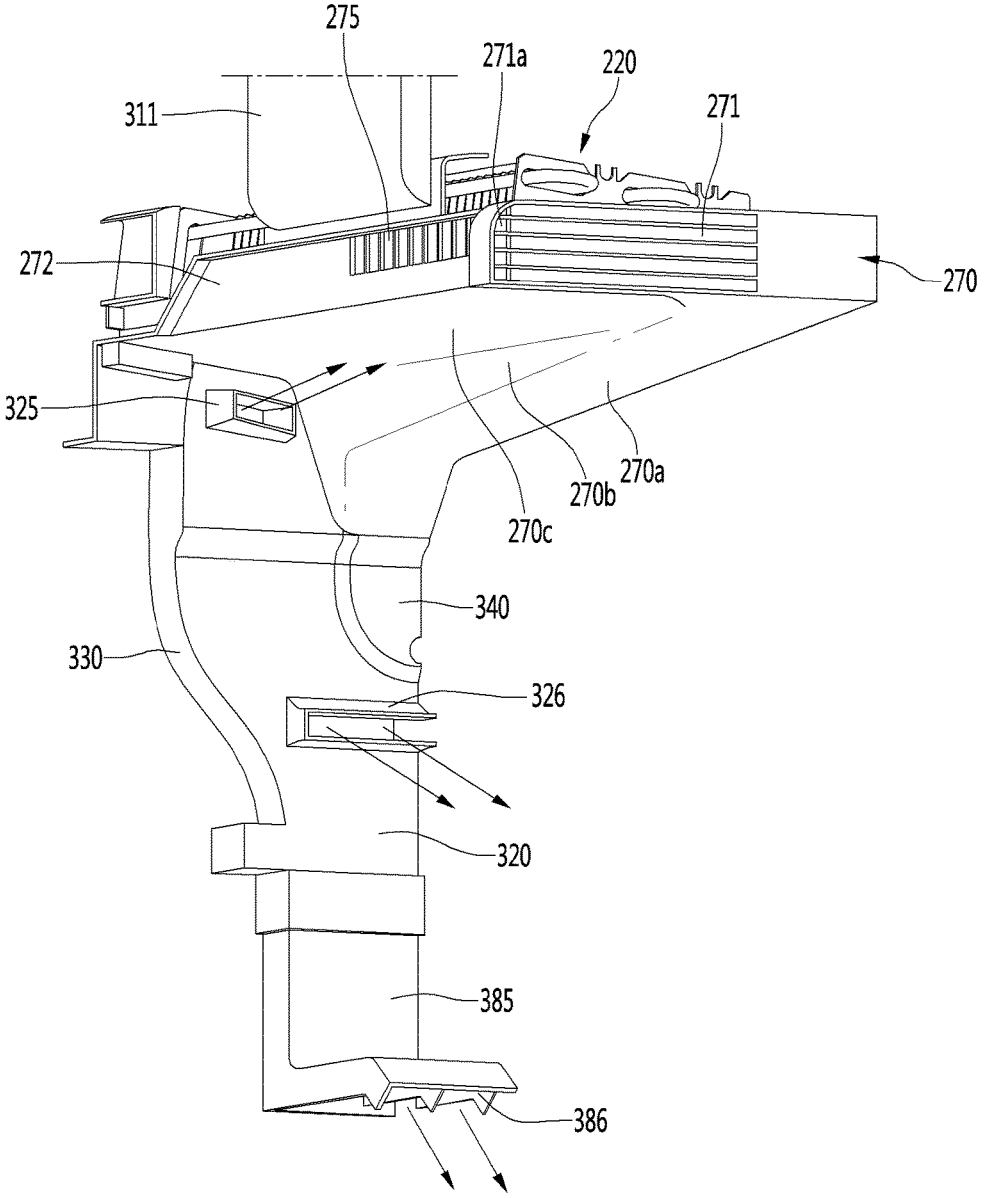
FIG. 13 illustrates a state in which cold air is discharged from a cold air supplying port according to the embodiment.

Referring to FIG. 13, the first supply ports 325 may be arranged on opposite sides of the bottom surface of the second cover 270. The second cover 270 may include the second front cover 271 defining a front surface thereof, the two second side covers 272 extending rearward from opposite sides of the second front cover 271, and bottom surfaces 270*a*, 270*b* and 270*c* extending rearward from a lower side of the second front cover 271.

The bottom surfaces 270*a*, 270*b* and 270*c* may be curved. The curved shapes of the bottom surfaces 270*a*, 270*b* and 270 may correspond to a structure of the evaporator 220, in which the evaporator 220 is inclined upward toward opposite sides thereof, for example, which has a shape that is similar to a V shape.

The bottom surfaces 270*a*, 270*b* and 270*b* may include a first bottom surface 270*a* located at a center thereof and inclined downward toward a rear of the refrigerator 10, and a second bottom surface 270*b* extending upward from a lateral side of the first bottom surface 270*a*, and a third bottom surface 270*c* extending sideways from an upper end of the second bottom surface 270*b*.

A vertical height of the second bottom surface 270*b* may increase toward a rear of the refrigerator 10, by the shape of the first bottom surface 270, which may be inclined downward toward a rear of the refrigerator 10. Further, the second bottom surface 270*b* may connect the first bottom surface 270*a* and the third bottom surface 270*c* to each other, and may be understood as a "step" defining a height difference between the first and third bottom surfaces 270*a* and 270*c*.

The first supply ports 325 may be located on lateral sides of the second bottom surface 270*b* and may be located on a lower side of the third bottom surface 270*c*. According to such arrangement, the air supplied through the first supply ports 325 may flow to an upper portion of the freezing chamber 13 and may flow toward the bottom surfaces 270*a*, 270*b* and 270*c* of the second cover 270.

Thus, the drawers 35 arranged in the upper space of the freezing chamber 13 may be easily cooled, and the condensed water generated on the bottom surfaces 270*a*, 270*b* and 270*c* of the second cover 270 may be evaporated or frost on the bottom surfaces 270*a*, 270*b* and 270*c* may be removed. Further, the air may be discharged toward the bottom surfaces 270*a*, 270*b* and 270*c* of the second cover 270 through the first supply ports 325, so that the discharged air may be prevented from being directly sucked to the cover discharge holes 275 formed in the second side covers 272 of the second cover 270.

Referring to FIGS. 15 to 18, the cold air supplying device 100 according to the embodiment may include the evaporator 220 installed inside the evaporator cases 210 and 270. The evaporator 220 may include the refrigerant pipes 221 through which the refrigerant flows and the fins 223 coupled to the refrigerant pipes 221. As an example, the refrigerant pipes 221 may be bent several times, may extend transversely, and may be vertically arranged in two rows. According to such a configuration, a flow distance of the refrigerant is increased, so that a heat exchange amount may be increased.

The fins 223 may vertically extend to be coupled to the two-row refrigerant pipes 221, and may guide flow of the cold air to promote heat exchange between the cold air and the refrigerant. According to the refrigerant pipes 221 and the fins 223, heat exchange performance of the refrigerant may be improved.

The cold air supplying device 100 may include an inlet pipe 222*a* connected to inlets of the refrigerant pipes 221 to introduce the refrigerant into the refrigerant pipes 221 and an outlet pipe 222*b* connected to outlets of the refrigerant pipes 221 such that the refrigerant circulating in the refrigerant pipes 221 is discharged through the outlet pipe 222*b*. The inlet pipe 222*a* and the outlet pipe 222*b* may be arranged at a central portion of the evaporator 220.

Figure 19:
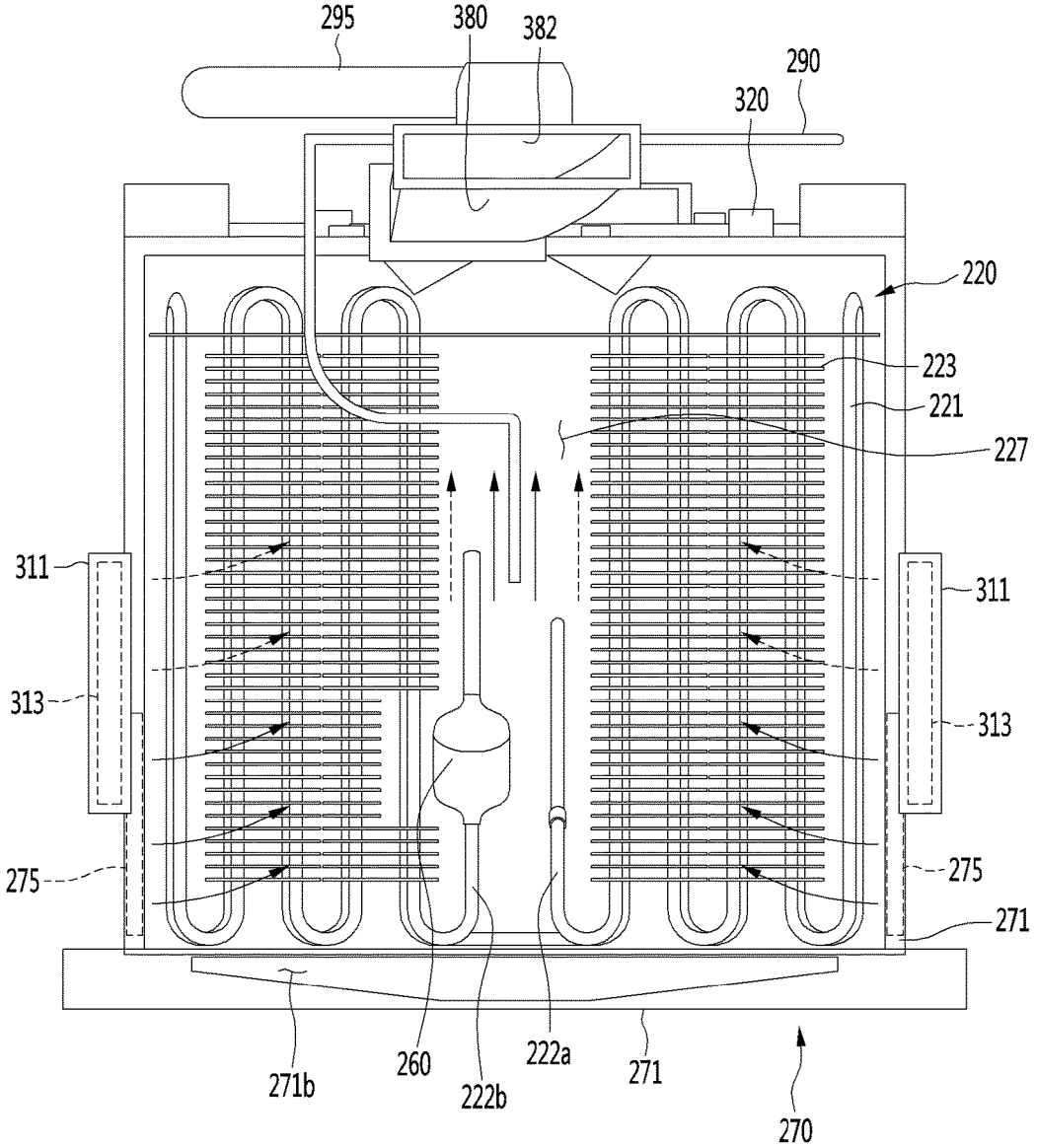
FIG. 19 illustrates flow of cold air passing through the evaporator according to the embodiment.
Figure 20:
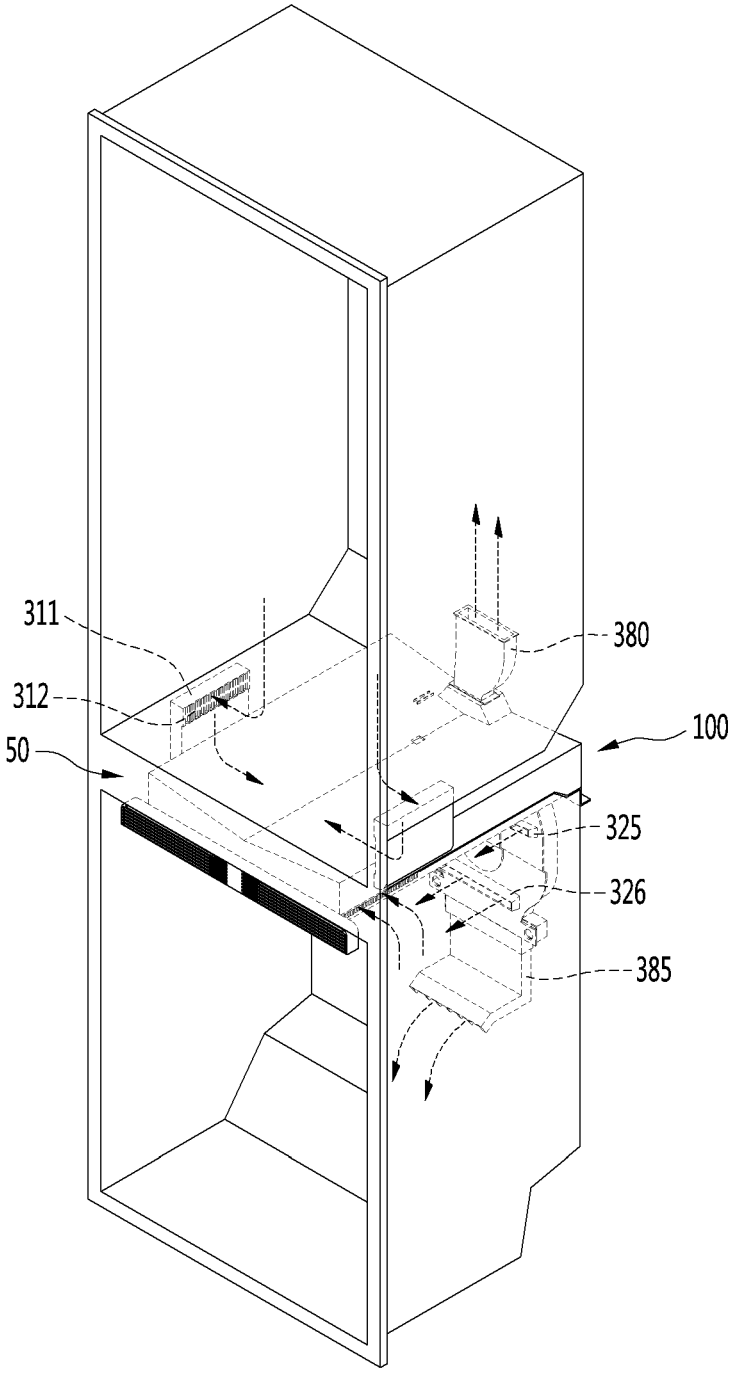
FIGS. 20 and 21 illustrate a state in which the cold air cooled by the evaporator is supplied to storage chambers according to the embodiment.
Figure 21:
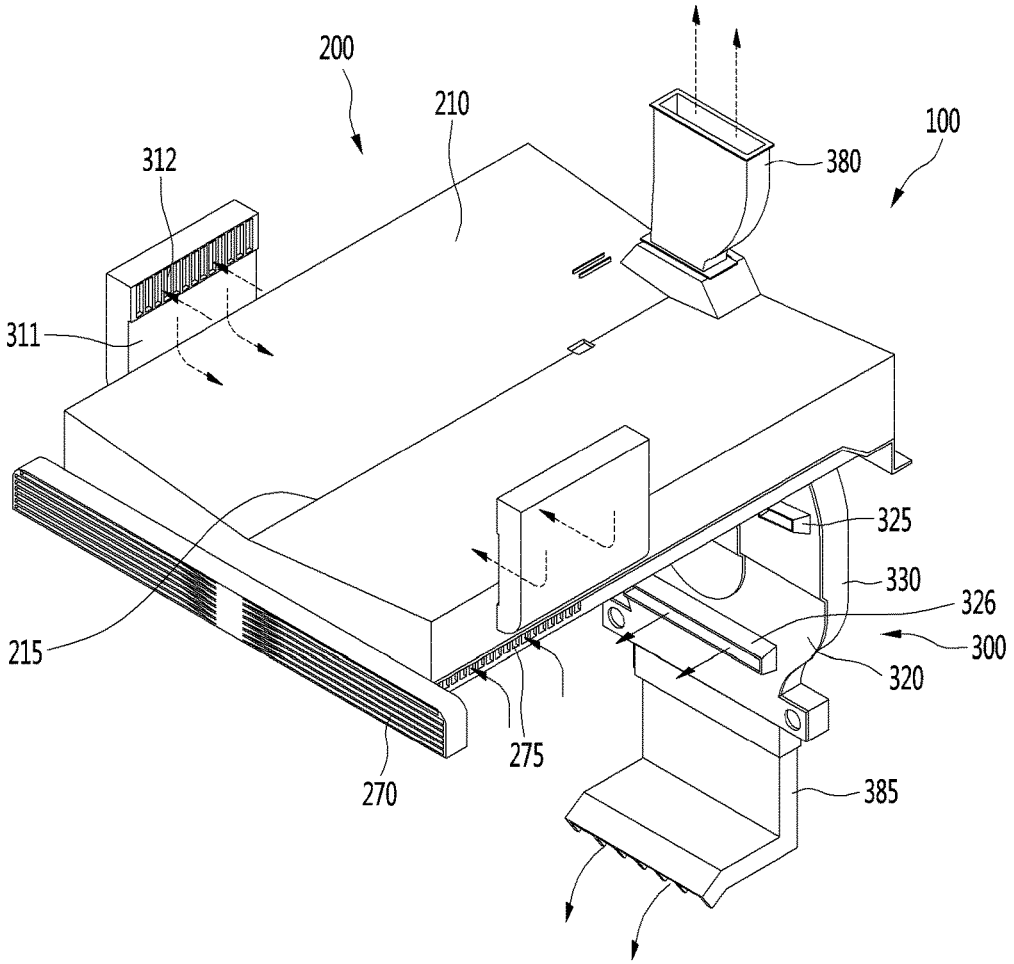

Further, a gas/liquid separator 260 configured to separate gas refrigerant from the refrigerant passing through the evaporator 220 and supply the separated gas refrigerant to the suction pipe 290 may be installed at an exit of the outlet pipe 222*b*. The gas/liquid separator 260 may be installed in a fan suction passage 227. According to such arrangement of the gas/liquid separator 260, the gas/liquid separator 260 may be arranged at a relatively low position, and accordingly, the vertical height of the cold air supplying device 100 may be reduced (see FIG. 19).

As an example, the refrigerant introduced into the lower-row refrigerant pipe 221 of the evaporator 220 through the inlet pipe 222*a* may flow to a left side (or a right side), flow to the upper-row refrigerant pipe 221, and then flows to the right side (or the left side) toward an opposite portion of the evaporator 220. Further, the refrigerant may be introduced into the low-row refrigerant pipe 221 of the refrigerant pipe 221, may flow toward the central portion of the evaporator 220, and may be discharged through the outlet pipe 222*b*.

The plurality of fins 223 may be provided. The plurality of fins 223 may be spaced apart from each other in the first direction. Further, some fins 223 among the plurality of fins 223 may extend in a transverse or second direction or a left-right direction. The fins 223 constituting such arrangement may be named "guide fins". The guide fins may extend from side parts or portions 220*a* and 220*b* toward a central part or portion 220*c* of the evaporator 220 to guide flow of the cold air at the side parts.

According to such a configuration, when the cold air introduced from the opposite sides of the evaporator 220 flows to the central portion 220*c* of the evaporator 220, the cold air may easily flow along the plurality of fins 223, particularly, the guide fins. That is, a phenomenon in which the fins 223 disturb the flow of the cold air may be prevented. The evaporator 220 may further include the first heater 243 coupled to an upper portion of the refrigerant pipes 221 to provide a predetermined amount of heat to the evaporator 220 at a defrosting time of the evaporator 220 so as to melt ice frosted in the refrigerant pipes 221 or the fins 223.

The evaporator 220 may include the side portions 220*a* and 220*b* defining opposite side portions of the evaporator 220 and the central portion 220*c* defining a central portion of the evaporator 220. The side portions 220*a* and 220*b* may include a plurality of heat exchangers 220*a* and 220*b*. Further, the central portion 220*c* may include the fan suction passage 227 formed between the plurality of heat exchangers 220*a* and 220*b* to define a suction-side passage of the blowing fan 350.

The plurality of heat exchangers 220*a* and 220*b* may include a first exchanger 220*a* and a second heat exchanger 220*b*. Further, the fan suction passage 227 may be a cold air passage not having the refrigerant pipes 221 and the fins 223. As an example, the refrigerant pipes 221 and the fins 223 may not be arranged in the fan suction passage 227.

The fan suction passage 227 may be a passage formed on a rear side of a connector 221*a* of the evaporator 220, or a passage formed between the connector 221*a* and the blowing fan 350. According to such a configuration, the air cooled while passing through the first and second heat exchangers 220*a* and 220*b* may be joined in the fan suction passage 227 and may flow toward the blowing fan 350.

The first and second heat exchangers 220*a* and 220*b* may include the refrigerant pipes 221 and the fins 223. The refrigerant pipes 221 may include a connector 221*a* connecting the first and second heat exchangers 220*a* and 220*b* to each other. The connector 221*a* may have a bent shape, for example, a shape of a U-shaped pipe.

The connector 221*a* may be arranged on a front side of the evaporator 220 and may be supported by the first holder 231. The first holder 231 may include a connection support 231*a* supporting the connector 221*a*. The connection support 231*a* may be formed by recessing at least a portion of the first holder 231, and the connector 221*a* may be fitted in the recessed portion.

Figure 18:
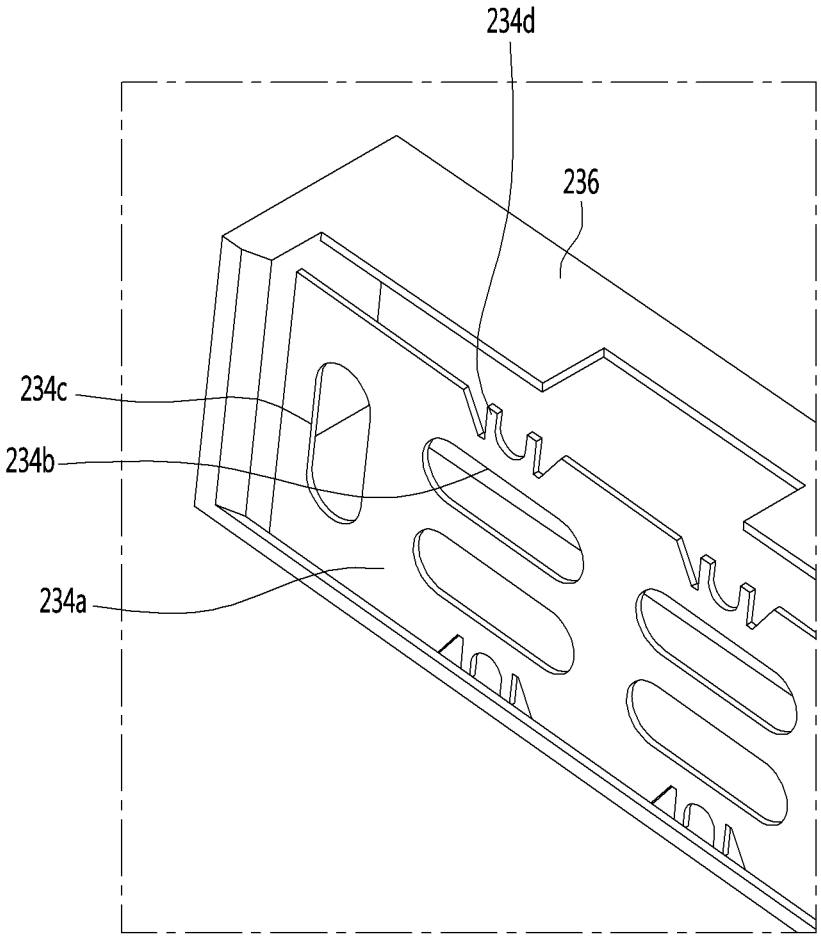
FIG. 18 illustrates configurations of a holder and a supporter that support the evaporator according to the embodiment.

The cold air supplying device 100 may include the first holder 231 supporting a front portion of the evaporator 220 and the second holder 233 supporting a rear portion of the evaporator 220. The first holder 231 or the second holder 233 may include through-holes 234*b* and 234*c* on which the refrigerant pipes 221 are supported. Referring to FIG. 18, the second holder 233 may include a holder body 234*a* having a shape of a plate and extending in the second direction and the plurality of through-holes 234*b* and 234*c* formed by penetrating at least portions of the holder body 234*a*.

The plurality of through-holes 234*b* and 234*c* may include a plurality of first through-holes 234*b* into which first bent pipes 221*b* of the refrigerant pipes 221 are inserted and second through-holes 234*c* into which second bent pipes 221*c* of the refrigerant pipes 221 are inserted. The plurality of first through-holes 234*b* may be arranged at upper and lower portions of the holder body 234*a* in two rows and may be spaced apart from each other in the second direction.

The first bent pipes 221*b* may be pipes provided at rear portions of the refrigerant pipes 221 to switch a flow direction of the refrigerant flowing through the refrigerant pipes 221 from a forward direction to a rearward direction or from a rearward direction to a forward direction. The first through-holes 234*b* may extend in the second direction.

Further, the second bent pipes 221*c* may be pipes provided at side portions of the refrigerant pipes 221 to switch the flow direction of the refrigerant flowing through the refrigerant pipes 221 from the lower row to the upper row of the refrigerant pipes 221. The second through-holes 234*c* may extend in a third direction, perpendicular to the first and second directions.

The second holder 233 may be coupled to the supporter 236. The supporter 236 may be coupled to the second holder 233 and may be located in front of the fan suction port 322 of the grill covers 320 and 330.

The second holder 233 may further include support bosses 234*d* provided at edges of the holder body 234*a* and supported on an inner surface of the supporter 236. The support bosses 234*d* may be provided on upper and lower sides of the first through holes 234*b* and may reduce a contact area of the supporter 236 and the second holder 233. According to such configurations of the support bosses 234*d*, stress transferred from the supporter 236 via the second holder 233 to the refrigerant pipes 221 may be reduced.

Further, the plurality of support bosses 234*d* may be provided, and a support space in which the first heater 243 is located may be formed between the plurality of support bosses 234*d*. According to such a configuration, when the first heater 243 is supported on the support space, the support bosses 234*d* may be supported on an inner surface of the supporter 236, so that the first heater 243 may be stably fixed.

Although a configuration of the holder has been described based on the second holder 233, the holder body 234*a*, the first through-holes 234*b* and the support bosses 234*d* provided in the second holder 233 may be identically applied to the first holder 231. The second holder 233 may further include a recessed part or recess 233*a* communicating with the fan suction passage 227 and configured to guide the cold air passing through the evaporator 220 such that the cold air flows toward the blowing fan 350.

The recess 233*a* may be formed at an approximately central portion of the holder body 234*a* to be recessed downward from an upper surface of the holder body 234*a*. Further, the recess 233*a* may be arranged on a front side of the fan suction port 322 of the grill covers 320 and 330. The cold air cooled by the evaporator 220 may be introduced into the fan suction port 322 via the fan suction passage 227 and the recess 233*a*.

The first heat exchanger 220*a* and the second heat exchanger 220*b* may extend from the central portion to the lateral sides of the evaporator 220 to intersect each other. In other words, the first heat exchanger 220*a* and the second heat exchanger 220*b* may be upward inclined upward toward the lateral sides with respect to the fan suction passage 227. That is, when a central portion of the fan suction passage 227 is defined as C3, and central lines I2 and I3 passing through vertical centers of the first and second heat exchangers 220*a* and 220*b* are defined, the central portion C3 and the central lines I2 and I3 may have a V shape or a wedge shape.

When a line passing through a vertical lengthwise center of the two-row refrigerant pipes 221 and the fins 223 provided in the first heat exchanger 220*a* and the central portion C3 is the first central line I2, the first central line I2 may extend to be inclined upward from the central portion C2 to a left side. That is, the first central line I2 may have a predetermined first setting angle θ1 with respect to a horizontal line I1. As an example, the first setting angle θ1 may have a range of 5-10°.

When a line passing through a vertical lengthwise center of the two-row refrigerant pipes 221 and the fins 223 provided in the second heat exchanger 220*b* and the central portion C3 is the second central line I3, the second central line I3 may be inclined upward from the central portion C2 to a right side. That is, the second central line I2 may have a predetermined first setting angle θ1 with respect to the horizontal line I1.

According to a configuration of the evaporator 220, a vertical width of the cold air supplying device 100 may be relatively reduced, so that a storage space of the freezing chamber 13 may be relatively increased. The vertical width of the cold air supplying device 100 may not be large, so that the relatively large thickness of the partition wall insulator 55 located in the partition wall 50 may be secured. As a result, there is an advantage in that even while the thickness of the partition wall insulator 55 is relatively increased, the entire thickness of the partition wall 50 and the cold air supplying device 100 may be relatively reduced.

Further, as compared with an evaporator horizontally arranged in a transverse direction, the heat exchange area of the evaporator 220 may be relatively increased, so that heat exchange performance may be improved. According to a configuration in which the evaporator 220 is inclined in a V shape, the first and second holders 231 and 233 supporting a front portion and a rear portion of the evaporator 220 may be also inclined upward from a central portion toward opposite sides thereof.

The defrosting water tray 240 configured to collect the defrosting water generated by the evaporator 220 may be installed on a lower side of the evaporator 220. The defrosting water tray 240 may be spaced downward apart from a lower end of the evaporator 220 to store the defrosting water falling down from the evaporator 220.

A lower surface of the defrosting water tray 240 may extend from a central portion toward a lateral side of the defrosting water tray 240 to be inclined upward with respect to the horizontal line I1. That is, the lower surface of the defrosting water tray 240 may have a predetermined second setting angle θ2 with respect to the horizontal line I1. The second setting angle θ2 may be slightly larger than the first setting angle θ1. As an example, the second setting angle θ2 may have a range of 10-15°.

The defrosting water tray 240 may include flow guides 244 inclined downward from opposite sides toward the central portion of the defrosting water tray 240. That is, the plurality of flow guides 244 may be provided on opposite sides of the defrosting water tray 240.

The downwards inclined shapes of the flow guides 244 correspond to the inclined shape of the evaporator 220, and accordingly, the defrosting water falling down to the defrosting water tray 240 may flow toward the central portion of the defrosting water tray 240 along the flow guides 244. The flow guides 244 may form the second setting angle θ2 with respect to the horizontal line I1.

A distance between the lower end of the evaporator 220 and the flow guides 244 may be gradually increased from the opposite sides to the central portion of the defrosting water tray 240. According to such a configuration, even though an amount of the defrosting water is increased while the defrosting water flows toward the central portion of the defrosting water tray 240 along the flow guides 244, the defrosting water may easily flow without interference from the evaporator 220.

The defrosting water tray 240 may further include a defrosting water storage part or trough 246 downwards recessed from the opposite flow guides 244. The defrosting water storage trough 246 may be formed below the fan suction passage 227.

An angle which is recessed, that is, inclined, from the flow guides 244 to the defrosting 1 water storage trough 246 may be larger than a downwards inclined angle of the flow guides 244. In this way, the defrosting water storage part 246 has a recessed shape, so that a discharge speed of the defrosting water flowing along the opposite flow guides 244 may be increased, and accordingly, the defrosting water may be easily discharged.

The defrosting water tray 240 may be inclined downward from a front portion to a rear portion thereof. The lower portion of the defrosting water tray 240 may extend downward while passing through the cover inserting holes 323 and 333 of the grill cover 320 and 330 and may be connected to the drain pipe 295. According to such a configuration, the defrosting water stored in the defrosting water storage part 246 may flow from the front portion to the rear portion of the defrosting water tray 240 and may be easily discharged to the drain pipe 295.

Referring to FIGS. 19 to 22, the cold air stored in the storage chambers 12 and 13 according to the embodiment may be introduced into the evaporation chamber in which the evaporator 220 is located, through each suction passage. The cold air stored in the refrigerating chamber 12 may be introduced into the evaporation chamber through the discharge ducts 311 constituting the refrigerating chamber suction passage (dotted line arrow). Further, the cold air stored in the freezing chamber 13 may be introduced into the evaporation chamber through the cover discharge holes 275 constituting the freezing chamber suction passage (solid line arrow).

As described above, the cover discharge holes 275 may be located relatively in front of the discharge ducts 311. Thus, the cold air in the freezing chamber, which is introduced into the evaporation chamber through the cover discharge holes 275, may be heat-exchanged while flowing from the front side toward the rear side of the evaporator 220. Thus, the heat exchange area of the cold air in the freezing chamber may be relatively large.

Thus, the cold air in the refrigerating chamber, which is introduced into the evaporation chamber through the discharge ducts 311, may be heat-exchanged while flowing from an approximately central portion toward the rear side of the evaporator 220. Thus, the heat exchange area of the cold air in the refrigerating chamber may be smaller than the heat exchange area of the cold air in the freezing chamber. However, cooling load of the cold air in the refrigerating chamber may not be larger than cooling load of the cold air in the freezing chamber, so that even when the suction passages are arranged as described above, sufficient cooling performance may be secured.

The plurality of fins 223 of the evaporator 220 may be spaced apart from each other from the front side toward the rear side of the evaporator 220. That is, the plurality of fins 223 may form a plurality of rows in the first direction. Further, front surfaces of the fins 223 constituting the rows may be arranged face a front side.

As an example, the front surfaces of the fins 223 constituting the plurality of rows may extend in parallel to each other in a transverse direction. According to such arrangement of the fins 223, the cold air flowing from the lateral sides of the evaporator 220 toward the central portion of the evaporator 220, that is, toward the fan suction passage 227 may be not interfered by the fins 223. As a result, the fins 223 may easily guide the flow of the cold air.

Such flow of the cold air may be performed on the opposite sides of the evaporator 220 through the first and second heat exchangers 220*a* and 220*b*. The cold air introduced from the opposite sides of the evaporator 220 may pass through the refrigerant pipes 221 and the fins 223, be combined with the fan suction passage 227, and then flow rearward.

Further, the cold air of the fan suction passage 227 may be introduced into the grill covers 320 and 330 through the fan suction part 322 and pass through the blowing fan 350. At least a portion of the cold air passing through the blowing fan 350 may flow to the refrigerating chamber cold air duct 81 through the first supply duct 380 and may be supplied to the refrigerating chamber 12 through the refrigerating chamber cold air supplying ports 82 (see arrow A of FIG. 22). The remaining cold air among the cold air passing through the blowing fan 350 may flow to the first and second supply ports 325 and 326 or the second supply duct 385 and may be supplied to the freezing chamber 13 (see arrow B of FIG. 22).

While the cold air is supplied through the evaporator 220, the condensed water f2 or the defrosting water f1 may be generated by the evaporator 220, and the condensed water or the defrosting water may fall down to the defrosting water tray 240 provided below the evaporator 220. The water collected in the defrosting water tray 240 may flow toward the rear side of the defrosting water tray 240.

As described above, the defrosting water tray 240 may be inclined downward from the front side toward the rear side thereof, so that the condensed water or the defrosting water may easily flow. The water flowing through the defrosting water tray 240 may pass through the grill covers 320 and 330, and is introduced into the drain pipe 295.

The condensed water f2 generated by the blowing fan 350 or in the grill covers 320 and 330 may fall down to the defrosting water tray 240 through the condensed water hole 338 and may be introduced into the drain pipe 295. The defrosting water f1 and the condensed water f2 may be combined with each other in the defrosting water tray 240 and may be introduced into the drain pipe 295.

The water introduced into the drain pipe 295 may flow downward to be introduced into the machine room 80, and may be collected in the drain fan provided in the machine room 80. According to such an operation, the defrosting water may be easily discharged.

A refrigerator may include evaporator cases arranged in a freezing chamber and located on a bottom surface of a partition wall, an evaporator installed inside the evaporator cases, and grill covers arranged on a rear side of the evaporator cases and having a blowing fan installed therein. The refrigerator may further include a refrigerating chamber discharge passage which extends from the grill covers to the refrigerating chamber and through which at least a portion of air passing through the blowing fan flows, and a freezing chamber discharge passage which extends from the grill covers to the freezing chamber and through which the remaining air among the air passing through the blowing fan flows.

The grill covers may include a first grill cover defining a front surface of the grill covers and having a fan suction part configured to guide the air to the blowing fan, and a second grill cover coupled to a rear portion of the first grill cover and having a fan seating part to which the blowing fan is mounted. The refrigerating chamber discharge passage may include a refrigerating chamber supply port formed above the grill covers and configured to discharge the at least a portion of the air, and a first supply duct communicating with the refrigerating chamber supply port and configured to guide the at least a portion of the cold air to the upper side.

The refrigerating chamber discharge passage may include a refrigerating chamber cold air duct communicating with the first supply duct and defining a rear wall of the refrigerating chamber, and a refrigerating chamber cold air supplying port provided on a front surface of the refrigerating chamber cold air duct and configured to supply the air to the refrigerating chamber. The freezing chamber discharge passage may include a first discharge passage formed above the grill covers and configured to discharge the air to an upper space of the freezing chamber, and a second discharge passage formed below the grill covers and configured to discharge the air to a lower space of the freezing chamber.

The first discharge passage may include first supply ports formed in the first grill cover and arranged on opposite sides of the fan suction port. the evaporator cases may include a first cover provided above the evaporator, and a second cover supporting a lower portion of the evaporator. The evaporator may extend to be inclined upwards from a central portion to opposite sides of the evaporator, and bottom surfaces of the second cover may have a curved shape to correspond to a shape of the evaporator.

The bottom surfaces of the second cover may include a first bottom surface located at a center of the bottom surfaces and extending to be inclined downwards toward a rear of the refrigerator 10, a second bottom surface extending upwards from the first bottom surface, and a third bottom surface extending sideways from an upper portion of the second bottom surface. The first supply ports may be located on lateral sides of the second bottom surface and may discharge the cold air toward the bottom surfaces of the second cover.

the first supply ports may be located on a lower side of the third bottom surface and may discharge the air toward the bottom surfaces of the second cover. The grill covers may include cover inserting holes, and the evaporator cases may include a defrosting water tray passing through the cover inserting holes and configured to collect condensed water.

The second discharge passage may include a second supply port formed in the first grill cover and located below the cover inserting holes to discharge the air to the freezing chamber. The freezing chamber discharge passage may include a second supply duct coupled to a lower portion of the grill covers and configured to discharge at least a portion of air passing through the blowing fan to the lower space of the freezing chamber.

The refrigerator may further include condensed water guides provided on a front surface of the first grill cover and configured to guide condensed water generated in the grill covers or by the blowing fan to the defrosting water guide. The condensed water guides may extend downward toward the fan suction port and may be rounded on opposite sides of the fan suction port and may be connected to the cover inserting holes.

Cover discharge holes configured to introduce the air in the freezing chamber into the evaporator cases may be formed on opposite side surfaces of the second cover. The cover discharge holes may be located laterally outside of the first supply ports. The first supply ports may be plural, and the plurality of first supply ports may be inclined from a front surface of the first grill cover to face a central portion of the grill covers.

The blowing fan may include a centrifugal fan through which cold air is sucked in an axial direction and is discharged to a circumferential direction. According to the refrigerator having the above-described configuration, because an evaporator may be installed on one side of a partition wall by which a refrigerating chamber and a freezing chamber are vertically partitioned, an internal storage space of the refrigerator may be enlarged, and withdrawal distances of drawers provided in the refrigerator may be increased. Thus, storage ability for food may be improved.

Further, a freezing chamber suction passage through which cold air is introduced from the freezing chamber into the evaporator and a refrigerating chamber suction passage through which cold air is introduced from the refrigerating chamber into the evaporator may be vertically arranged, so that flow resistance between the cold air introduced through the freezing chamber suction passage and the refrigerating chamber suction passage may be prevented from being generated. Further, the evaporator may include a first heat exchanger and a second heat exchanger spaced apart from each other, and a fan suction passage through which the cold air is sucked into a fan may be provided between the first and second heat exchangers, so that the cold air introduced from opposite sides of the partition wall may easily flow towards the fan located on a rear side of the partition wall.

Further, the first and second heat exchangers may be inclined from a central portion toward lateral sides of the evaporator, so that the heat exchange area of the evaporator may be increased, and the relatively large thickness of an insulator located in the partition wall may be secured. Further, a defrosting water tray may be provided on a lower side of the evaporator, and the defrosting water tray may be inclined downwards from opposite sides to the central portion to correspond to the shape of the evaporator, so that defrosting water may smoothly flow.

Further, because a recessed part is formed at a central portion of the defrosting water tray and the fan suction passage is formed above the recessed part, the defrosting water stored in the defrosting water tray may not contact the evaporator even when an amount of the defrosting water is increased, so that frost may be prevented from being generated at a lower portion of the evaporator. Further, the cold air introduced into a blowing fan through the fan suction passage may be branched into and flow through a discharge passage (refrigerating chamber discharge passage) toward the refrigerating chamber and a discharge passage (freezing chamber discharge passage) toward the freezing chamber, so that the freezing chamber and the refrigerating chamber may be efficiently cooled.

Further, because the blowing fan includes a centrifugal fan, the cold air introduced in an axial direction of the blowing fan may be discharged toward an outer peripheral surface of the blowing fan, so that the cold air may be easily branched into the refrigerating chamber discharge passage and the freezing chamber discharge passage. Further, the refrigerating chamber discharge passage may include a first supply duct, and the first supply duct may be connected to a refrigerating chamber cold air duct arranged on a rear wall of the refrigerating chamber and guides the cold air such that the cold air flows upwards from the partition wall, so that the cold air may be easily supplied to the refrigerating chamber.

Further, the freezing chamber discharge passage may include first supply ports, and the first supply ports may be arranged on opposite sides of the blowing fan, that is, above the freezing chamber, so that an upper space of the freezing chamber may be easily cooled. In particular, the drawers arranged in the upper space of the freezing chamber may be easily cooled. Further, a central portion of a second cover supporting a lower side of the evaporator may have a recessed shape to correspond to an inclined shape of the evaporator, so that a space of the freezing chamber may be relatively secured on opposite sides of a bottom surface of the second cover. Further, the first supply ports may be arranged on the opposite sides of the bottom surface of the second cover, and may discharge cold air toward the bottom surface of the second cover, so that condensed water generated on the bottom surface of the second cover may be evaporated or frost on the bottom surface of the second cover may be removed.

Further, the first supply ports may discharge the cold air toward the bottom surface of the second cover, so that the discharged cold air may be prevented from being directly sucked to the cover discharge holes formed on side surfaces of the second cover. Further, the freezing chamber discharge passage may include a second supply port, and the second supply port may be arranged on a lower side of the freezing chamber, so that a lower space of the freezing chamber may be easily cooled. In particular, the drawers arranged in the upper space of the freezing chamber may be easily cooled.

Further, a condensed water hole may be formed in grill covers accommodating the blowing fan, so that the blowing fan may be prevented from being frozen. Further, the condensed water hole may be formed below a fan seat of the grill covers on which the blow fan is seated, so that the condensed water generated by the blowing fan may be easily discharged.

Further, the defrosting water tray arranged below the evaporator may pass through the grill covers through a lower space of the condensed water hole, so that the condensed water flowing through the condensed water hole may be easily discharged through the defrosting water tray. Further, the defrosting water tray may be connected to the drain pipe, and water stored in the defrosting water tray may be easily discharged to a machine room of the refrigerator through the drain pipe.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet including a refrigerating chamber and a freezing chamber arranged below the refrigerating chamber;

a partition wall provided between the refrigerating chamber and the freezing chamber and having a partition wall insulator;

an evaporator case arranged in the freezing chamber and located on a lower surface of the partition wall;

an evaporator installed in the evaporator case;

a grill cover attached to a rear side of the evaporator case and in which a blowing fan is installed;

a first supply duct that extends from the grill cover to the refrigerating chamber and through which a first portion of air passing through the blowing fan flows; and a second supply duct that extends from the grill cover to the freezing chamber and through which a second portion of air passing through the blowing fan flows, wherein the evaporator case comprises a first cover provided above the evaporator and a second cover supporting a lower portion of the evaporator, and wherein a first section of the evaporator is inclined from a central portion to a first side of the evaporator, and a second section of the evaporator is inclined from a central portion to a second side of the evaporator, and wherein a bottom surface of the second cover is inclined to correspond to the inclination of the evaporator.

2. The refrigerator of claim 1, wherein the grill cover includes:

a first grill cover defining a front surface of the grill cover and having a fan suction port configured to guide the air to the blowing fan; and a second grill cover coupled to a rear portion of the first grill cover and having a fan seat to which the blowing fan is mounted.

3. The refrigerator of claim 2, further including:

a plurality of first supply ports formed at an upper portion of the grill cover and configured to discharge air to an upper space of the freezing chamber; and a second supply port formed at a lower portion of the grill cover and configured to discharge air to a lower space of the freezing chamber.

4. The refrigerator of claim 3, wherein the plurality of first supply ports are arranged on opposite sides of the fan suction port.

5. The refrigerator of claim 3, wherein the grill cover includes a cover inserting hole, and wherein the evaporator case includes a defrosting water tray passing through the cover inserting hole and configured to collect condensed water.

6. The refrigerator of claim 5, wherein the second supply port is formed in the first grill cover and located below the cover inserting hole to discharge air to the freezing chamber.

7. The refrigerator of claim 5, further including at least one condensed water guide provided on a front surface of the first grill cover, the at least one condensed water guide being configured to guide condensed water generated in the grill cover or the blowing fan to the defrosting water tray.

8. The refrigerator of claim 7, wherein the at least one condensed water guide extends from an upper portion of the first grill cover toward the fan suction port, is rounded along the fan suction port, and is connected to the cover inserting hole.

9. The refrigerator of claim 3 wherein the second supply duct is coupled to a lower side of the grill cover and is configured to discharge at least a portion of air passing through the blowing fan to the lower space of the freezing chamber.

10. The refrigerator of claim 1, wherein the first supply duct includes:

a refrigerating chamber supply port formed at an upper portion of the grill cover and configured to discharge the first portion of the air; wherein the first supply duct communicates with the refrigerating chamber supply port and is configured to guide the first portion of the air upward.

11. The refrigerator of claim 10, further including:

a refrigerating chamber cold air duct communicating with the first supply duct and defining a rear wall of the refrigerating chamber; and at least one refrigerating chamber cold air supplying port provided on a front surface of the refrigerating chamber cold air duct and configured to supply the air to the refrigerating chamber.

12. The refrigerator of claim 1, wherein the bottom surface of the second cover includes:

a first bottom surface defining a central portion of the bottom surface and extending in a declined manner toward a rear of the second cover;

at least one second bottom surface extending upwards from the first bottom surface; and at least one third bottom surface extending sideways from an upper portion of the at least one second bottom surface.

13. The refrigerator of claim 12, wherein the plurality of first supply ports are located on either side of the second bottom surface and discharge air toward the bottom surface of the second cover.

14. The refrigerator of claim 12, wherein the plurality of first supply ports are located on a lower side of the third bottom surface and discharge air toward the bottom surface of the second cover.

15. The refrigerator of claim 1, wherein cover discharge holes configured to introduce the air in the freezing chamber into the evaporator case are formed on opposite side surfaces of the second cover.

16. The refrigerator of claim 15, wherein the cover discharge holes are located further away from a center of the refrigerator than the plurality of first supply ports.

17. The refrigerator of claim 16, wherein the plurality of first supply ports are inclined from a front surface of the first grill cover toward a central portion of the grill cover.

18. The refrigerator of claim 16, wherein the blowing fan includes a centrifugal fan through which air is sucked in an axial direction and is discharged in a circumferential direction.

19. A refrigerator comprising:

a cabinet including a refrigerating chamber and a freezing chamber arranged below the refrigerating chamber;

a partition wall provided between the refrigerating chamber and the freezing chamber and having a partition wall insulator;

an evaporator case arranged in the freezing chamber and located on a lower surface of the partition wall;

an evaporator installed in the evaporator case;

a grill cover attached to a rear side of the evaporator case and in which a blowing fan is installed;

a first supply duct that extends from the grill cover to the refrigerating chamber and through which a first portion of air passing through the blowing fan flows;

a second supply duct that extends from the grill cover to the freezing chamber and through which a second portion of air passing through the blowing fan flows; and at least one first supply port formed at an upper portion of the grill cover and configured to discharge air to an upper space of the freezing chamber, wherein the evaporator case comprises a first cover provided above the evaporator and a second cover supporting a lower portion of the evaporator, wherein a cover discharge hole configured to introduce the air in the freezing chamber into the evaporator case is formed on a side surface of the second cover, the cover discharge hole being located further away from a center of the refrigerator than the at least one first supply port, and wherein the at least one first supply port is inclined from a front surface of the grill cover toward a central portion of the grill cover.

20. A refrigerator comprising:

a cabinet including a refrigerating chamber and a freezing chamber arranged below the refrigerating chamber;

a partition wall provided between the refrigerating chamber and the freezing chamber and having a partition wall insulator;

an evaporator case arranged in the freezing chamber and located on a lower surface of the partition wall;

an evaporator installed in the evaporator case;

a grill cover attached to a rear side of the evaporator case and in which a blowing fan is installed, wherein the grill cover includes:

a first grill cover defining a front surface of the grill cover and having a fan suction port configured to guide the air to the blowing fan; and a second grill cover coupled to a rear portion of the first grill cover and having a fan seat to which the blowing fan is mounted;

a first supply duct that extends from the grill cover to the refrigerating chamber and through which a first portion of air passing through the blowing fan flows;

a second supply duct that extends from the grill cover to the freezing chamber and through which a second portion of air passing through the blowing fan flows; and a plurality of first supply ports formed at an upper portion of the grill cover and configured to discharge air to an upper space of the freezing chamber, wherein the plurality of first supply ports are arranged on opposite sides of the fan suction port.

21. A refrigerator comprising:

a cabinet including a refrigerating chamber and a freezing chamber arranged below the refrigerating chamber;

a partition wall provided between the refrigerating chamber and the freezing chamber and having a partition wall insulator;

an evaporator case arranged in the freezing chamber and located on a lower surface of the partition wall, the evaporator case including a defrosting water tray configured to collect condensed water;

an evaporator installed in the evaporator case;

a grill cover attached to a rear side of the evaporator case and in which a blowing fan is installed, wherein the grill cover includes:

a first grill cover defining a front surface of the grill cover and having a fan suction port configured to guide the air to the blowing fan; and a second grill cover coupled to a rear portion of the first grill cover and having a fan seat to which the blowing fan is mounted;

a first supply duct that extends from the grill cover to the refrigerating chamber and through which a first portion of air passing through the blowing fan flows;

a second supply duct that extends from the grill cover to the freezing chamber and through which a second portion of air passing through the blowing fan flows;

a supply port formed at a lower portion of the first grill cover and configured to discharge air to a lower space of the freezing chamber, wherein the grill cover includes a cover inserting hole through which the defrosting water tray passes, and wherein the supply port is located below the cover inserting hole to discharge air to the freezing chamber.

* * * * *